US008082867B2

(12) United States Patent
Koole et al.

(10) Patent No.: US 8,082,867 B2
(45) Date of Patent: Dec. 27, 2011

(54) SHIP WITH LIQUID TRANSPORT TANKS PROVIDED WITH DEFORMATION ABSORBERS

(75) Inventors: Jacob Koole, Schoorl (NL); Martijn Pieter van Poppelen, Enschede (NL)

(73) Assignee: ORCA V.O.F., Enschede (NL)

( * ) Notice: Subject to any disclaimer, the term of this patent is extended or adjusted under 35 U.S.C. 154(b) by 458 days.

(21) Appl. No.: 11/909,861

(22) PCT Filed: Apr. 3, 2006

(86) PCT No.: PCT/NL2006/000171

§ 371 (c)(1),
(2), (4) Date: Sep. 27, 2007

(87) PCT Pub. No.: WO2006/104386

PCT Pub. Date: Oct. 5, 2006

(65) Prior Publication Data

US 2008/0184926 A1 Aug. 7, 2008

(30) Foreign Application Priority Data

Apr. 1, 2005 (NL) ..... 1028679

(51) Int. Cl.
*B63B 25/08* (2006.01)

(52) U.S. Cl. ..... 114/74 R

(58) Field of Classification Search ..... 114/74 A, 114/74 R, 79 R, 80, 536; 220/560.06, 560.07, 220/560.11

See application file for complete search history.

(56) References Cited

U.S. PATENT DOCUMENTS

| | | | | |
|---|---|---|---|---|
| 2,994,452 | A * | 8/1961 | Morrison | 220/560.08 |
| 3,613,932 | A * | 10/1971 | Yamamoto | 220/560.07 |
| 5,375,549 | A * | 12/1994 | Hirose | 114/74 R |
| 6,167,827 | B1 | 1/2001 | Keehan | |

FOREIGN PATENT DOCUMENTS

| | | |
|---|---|---|
| DE | 93 09 433 | 5/1994 |
| NL | 1011836 | 12/2000 |

OTHER PUBLICATIONS

English abstract of NL 1011836.

* cited by examiner

*Primary Examiner* — Edwin Swinehart
(74) *Attorney, Agent, or Firm* — Hoffmann & Baron, LLP

(57) ABSTRACT

A ship (20) with one or more liquid transport tanks (21) arranged in an upright position in a ship's hull, said transport tanks having an axial direction and a circumferential direction, and each transport tank comprising a tank bottom (22), a tank circumferential wall (25) and a tank roof (23), the tank bottom being supported on or forming part of a lower deck of the ship's hull. The tank circumferential wall is suspended by its lower and upper ends by means of deformable deformation absorbers (26) between the lower deck and an upper deck (24) of the ship's hull, which deformation absorbers are designed so as to absorb deformations between the ship's hull and the tank circumferential wall at least in the abovementioned axial direction, at least the lower deformation absorber extending in the circumferential direction around substantially the entire circumference of the tank circumferential wall, and at least the lower deformation absorber forming part of the tank wall and being accommodated at the position of the transition between the tank circumferential wall and the tank bottom so as to form a continuous sealing connection between them.

42 Claims, 20 Drawing Sheets

SHIP WITH LIQUID TRANSPORT TANKS PROVIDED WITH DEFORMATION ABSORBERS

CROSS-REFERENCE TO RELATED APPLICATIONS

This application is the National Stage of International Application No. PCT/NL2006/000171, filed Apr. 3, 2006, which claims the benefit of Netherlands Application No. NL 1028679, filed Apr. 1, 2005, the contents of which are incorporated by reference herein.

FIELD OF THE INVENTION

The invention relates to a ship with one or more liquid transport tanks which are provided in a ship's hull for transporting liquid media.

BACKGROUND OF THE INVENTION

The current mode of transporting liquid media, such as chemicals, oil and agricultural products, is mainly in tankers which are equipped with rectangular cargo tanks that are integral with the ship, so-called parcel tankers. The cargo tanks are part of the ship's structure, in which the tank walls are formed by the ship's hull, profiled cross bulkheads and longitudinal bulkheads placed therein, and the ship's deck.

The disadvantage here is that cracks can occur in the tank walls through deformations of the ship in heavy seas and through temperature differences. The abovementioned deformations cause high stress concentrations in the tanks, particularly on the corner points, which can result in the formation of cracks. If this happens, an opening can develop between two adjacent tanks, with the result that undesirable mixing of the stored products can occur. In the current regulations it has already been stipulated for many products that adjacent tanks must not be filled with different products, this being to prevent the risk of cross-contamination and to avoid a dangerous situation. Owing to the fact that different products can be transported in the tanks, the tanks have to be carefully cleaned after delivery, in order to ensure that a product to be transported after that is not contaminated. However, the tanks are difficult to clean. This is partly because of the fact that the walls are of a partially profiled design in order to make them sufficiently rigid, and the fact that they have corner points. This means that a relatively large quantity of flushing water is needed for cleaning the tanks, which is expensive and undesirable from an environmental point of view because the flushing water sometimes has to be discharged as chemical waste. In addition, a slight degree of contamination remaining in the tank cannot always be detected by a routine check, with the result that damage can occur to the products subsequently transported. Owing to the fact that the tanks are more difficult to insulate, greater temperature differences can occur in the stored products. It is also necessary to heat to a higher temperature in order to be able to maintain a desired temperature in the tank. The higher temperatures can cause deterioration of the product.

In the art a search has been going on for alternatives for quite some time now, one idea being, for example, to place several cylindrical storage tanks in the ship's hull. See, for example, U.S. Pat. No. 6,167,827 or DE-U-93.09.433.

Further, a is known from NL-C-1011836. This publication discloses a ship with a cylindrical transport tank placed in the ship's hull. In this case the bottom of the tank is supported on the ship's hull and is connected to a cylindrical tank circumferential wall. Spring means are provided between the lower side of the tank circumferential wall and the ship's hull. The spring means serve to limit a movement of the tank circumferential wall upwards and downwards. This means that cargo in the transport tank is supported via the bottom of the tank directly on the ship's hull, while the tank circumferential wall can move slightly relative to the ship's hull within the limits formed by the spring means.

It is a disadvantage here that the tank circumferential wall has to be of a relatively thick-walled design. Furthermore, it is a disadvantage that a relatively heavy tank roof is necessary. As a result of this, the total weight of the transport tank is relatively high. The possibilities for scaling up are limited, while the spring means are fragile and require maintenance. Deck passages for the tank have to be flexible.

SUMMARY OF THE INVENTION

The object of the present invention is to provide a ship with one or more liquid transport tanks placed in a ship's hull, in which the abovementioned disadvantages are at least partially overcome, or to provide a usable alternative. In particular, the object of the invention is to provide a great saving on material for liquid transport tanks which are to be placed in a ship, with the transport tanks being sturdy and being insensitive to sustained heavy ship movements and deformations. More particularly, it is an object to make scaling up possible and to provide a simple construction requiring little to no maintenance.

This object is achieved according to the present invention by a ship with one or more liquid transport tanks provided in the ship's hull. Each transport tank comprises a tank roof and a tank bottom which is supported on a lower deck of the ship's hull or is integral therewith. The tank circumferential wall extending between the above two parts is in particular of a substantially cylindrical design, but it can also be of another shape, for example oval, square, multi-lobed with partitions, or polygonal. The tank circumferential wall is connected by its lower end to a first deformation absorber, which in turn is connected directly or indirectly to a lower deck of the ship's hull. Furthermore, the tank circumferential wall is connected by its upper end to a second deformation absorber, which in turn is directly or indirectly connected to an upper deck of the ship's hull. The tank circumferential wall is therefore suspended by its upper and lower ends from the deformation absorbers between an upper and lower deck of the ship's hull. The deformation absorbers are designed in such a deformable manner that deformations, for example as a result of deformations of the ship's hull, can be absorbed by a suitable deformation of the absorbers without causing deformation of or placing an undue load upon the tank circumferential wall in the process. The lower deformation absorber extends in the circumferential direction around the entire circumference of the tank circumferential wall, forms part of the tank wall, and forms a continuous sealing connection between the tank circumferential wall and the bottom of the tank.

According to the invention, one of the main functions of the deformation absorbers is to reduce axial stresses in the tank circumferential wall. Reducing axial pressure stresses in the tank circumferential wall reduces the chance of crumpling of the tank circumferential wall. The axial rigidity of the deformation absorbers can be selected in such a way that advantageously no rigidity need be added to the tank circumferential wall in order to prevent axial crumpling. The necessary wall thickness of the tank circumferential wall can therefore advantageously be kept low. The necessary wall thickness is now substantially determined by the internal pressure of the stored liquid, axial crumpling stresses as a result of bending moments, shearing stresses and producibility.

Horizontal loads will be transmitted to the ship on the lower side and upper side of the tank circumferential wall by way of the deformation absorbers substantially by means of shearing forces. This can be achieved by a relatively great rigidity of the deformation absorbers in the circumferential direction of the tank circumferential wall. The deformation absorbers then, as it were, retain the tank circumferential wall in the circumferential direction. The deformation absorbers can even be made of a substantially rigid design in the abovementioned circumferential direction and are then well suited for transmitting the horizontal loads to the ship, and for holding the tank circumferential wall in position.

According to the invention, the tank circumferential wall can retain its shape and will not crumple. Acceleration forces on the liquid medium stored in the tank will result in relatively small reaction forces on the upper and lower side of the transport tank. A maximum moment as a result of this play of forces now occurs substantially halfway up the tank. This maximum moment is also relatively small. The stresses are well distributed over the tank circumferential wall, the maximum axial stresses occurring substantially at the position halfway down the tank circumferential wall, and the maximum shearing stresses occurring at the position of the connection to the deformation absorbers. The minimum wall thickness of the tank circumferential wall can consequently be kept advantageously low. The circumferential wall can even be, as it were, in a membrane-like form, in particular if said wall is cylindrical.

The rigidities of the deformation absorbers in the axial direction and in the circumferential direction can be influenced by varying the shape and wall thickness of the deformation absorbers.

Owing to the fact that horizontal forces on the transport tank are transmitted to the ship both on the lower side and on the upper side, a uniform load occurs on the ship's hull. No additional supporting structures are needed halfway along the ship's hull. Passages through the upper deck for loading and unloading need not be flexibly connected to the tank. The thin tank wall can be well insulated, which produces a saving in energy and a high product quality after transportation. The service life of the transport tank will be long, and the transport tank will require virtually no maintenance. The risk of the tank wall cracking in the event of a collision will be reduced. The deformation absorbers and the tank wall can absorb some of the deformation as a result of the collision. Finally, the deformation absorbers are also suitable for absorbing the expansion or shrinkage of the tank wall occurring depending on the temperature of the cargo.

Owing to the fact that the tank circumferential wall is, as it were, suspended between two springs (the deformation absorbers), the tank circumferential wall will sink slightly under the influence of gravity. The degree of sinkage or movement is determined here by the spring rigidity of the deformation absorbers in the axial direction and the mass of the tank circumferential wall. Limiting the spring rigidity of the deformation absorbers in the upward direction will cause the tank circumferential wall to sink significantly after placing between the deformation absorbers, thus compressing or extending the deformation absorbers.

In an advantageous embodiment the deformation absorbers are designed in the circumferential direction of the tank circumferential wall with a rigidity that is greater than or equal to $\frac{1}{3}^{rd}$ of the rigidity of a reference wall which is straight all the way down, is made of the same material, and has the same wall thickness curve as the tank circumferential wall with the deformation absorbers.

In a further advantageous embodiment the deformation absorbers are designed in the axial direction of the tank circumferential wall in such a way that the ratio of the spring rigidity in the axial direction of a reference wall which is straight all the way down, is made of the same material, and has the same wall thickness curve as the tank circumferential wall together with the deformation absorbers, is greater than 2 relative to the tank circumferential wall together with the deformation absorbers.

It is preferable for both of the abovementioned conditions for the spring rigidity to be met. In this way the tank circumferential wall is suspended between the two deformation absorbers on the ship's hull.

The tank roof can form an integral part of an upper deck of the ship's hull.

If, however, the tank bottom and/or the tank roof are designed separately, they can follow the deformations of the ship's hull without undue resistance, and the wall thicknesses of the tank bottom and the tank roof can advantageously be kept low. All of this together makes it possible for considerable savings on material to be achieved.

In particular, the upper deformation absorber also extends over substantially the entire circumference of the tank circumferential wall. This continuous connection ensures that local stress concentrations are prevented.

More particularly, the upper deformation absorber also forms part of the tank wall and is accommodated at the position of the transition between the tank circumferential wall and the tank roof. The deformation absorber forms a continuous sealing connection between said circumferential wall and said tank roof.

Separate deformable support elements can be provided for supporting the tank circumferential wall in the axial direction and/or for the partial absorption of the liquid pressure. The deformation absorbers can then be designed so as to be substantially freely movable in the axial direction, in other words without undue resistance. It is, however, also possible to make the deformation absorbers so rigid in the axial direction of the tank that the two deformation absorbers together can partially or even fully support the tank circumferential wall. In the latter case the tank circumferential wall is ultimately, as it were, suspended between the deformation absorbers without additional support elements having to be provided.

The deformation absorbers are advantageously rigid at least in the circumferential direction of the transport tank. This can be achieved by a suitable ratio between the shape, wall thickness, strength and rigidity in the various directions of the deformation absorbers. Since the deformation absorbers are rigid in the circumferential direction, in other words under load they retain their shape in the circumferential direction, they hold the tank circumferential wall in place.

Further preferred embodiments of the ship are described in the subclaims.

The invention further relates to a transport tank for a ship according to the invention, to a method for placing such a transport tank in a ship, and to a use of such a ship.

BRIEF DESCRIPTION OF THE DRAWINGS

The invention will be explained in greater detail with reference to the appended drawings, in which.

DETAILED DESCRIPTION OF PREFERRED EMBODIMENTS

Figure 1:
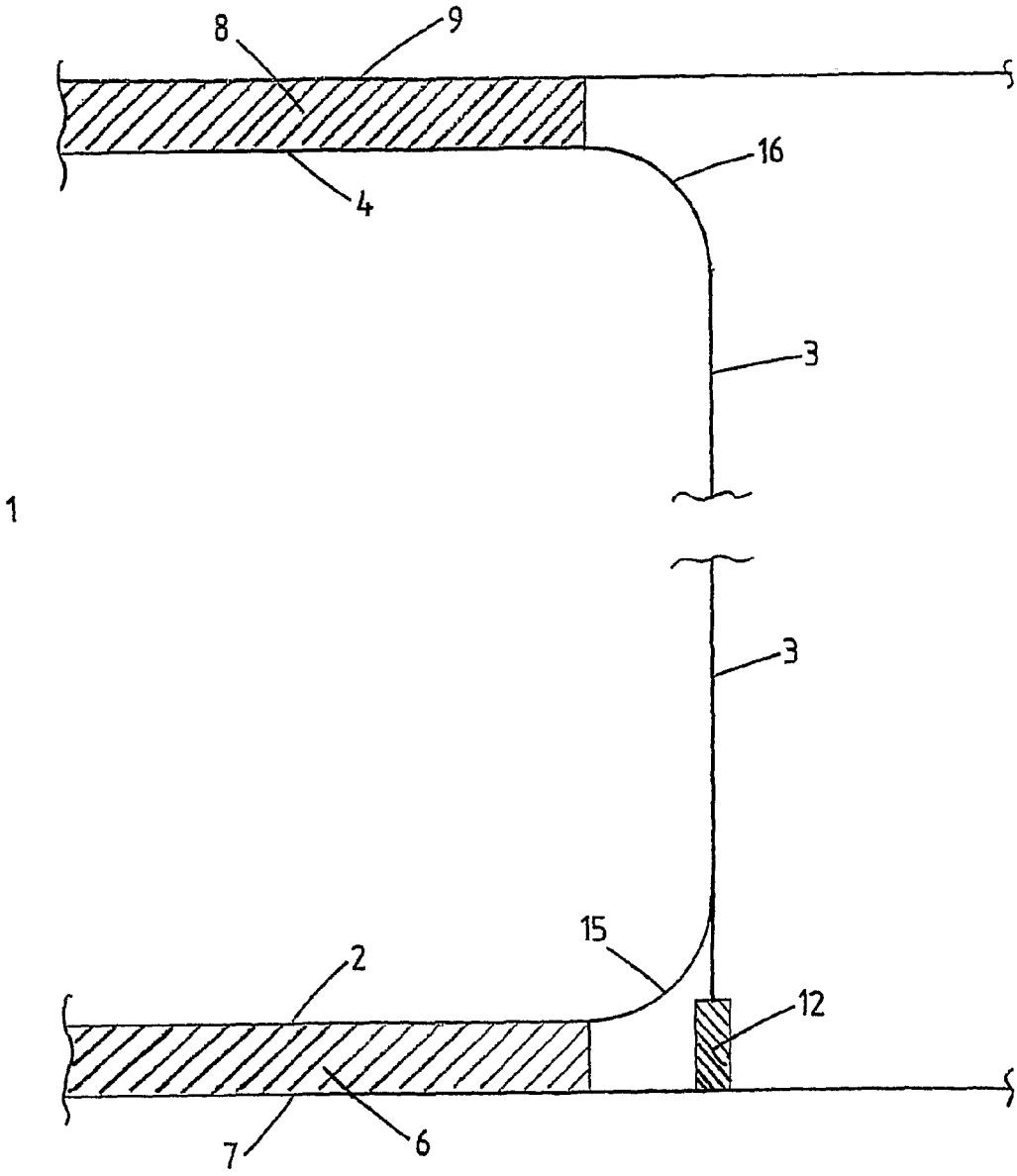
FIG. 1 is a diagrammatic partial view in cross section of an embodiment of a cylindrical transport tank according to the invention placed in a ship's hull.

In FIG. 1 the transport tank is indicated in its entirety by the reference numeral 1. The transport tank 1 consists of a tank bottom 2, a cylindrical tank circumferential wall 3 and a tank roof 4. The tank bottom 2 is of a flat design and, with the interposition of an insulating layer 6, is connected to a lower deck 7 of a hull of a ship not shown in any greater detail. The tank roof 4 is connected to an upper deck 9 of the ship's hull, with the interposition of an insulating layer 8. The tank circumferential wall 3 is partially supported towards the bottom by deformable support means 12. The support means 12 engage upon the bottom part of the tank circumferential wall 3. Deformation absorbers 15, 16 are accommodated in the tank wall. The deformation absorbers 15, 16 are formed here as sections which are quadrantal-shaped (shaped like a quarter circle) in cross section and extend between the tank bottom 2 or the tank roof 4 and the tank circumferential wall 3 respectively. The deformation absorbers 15, 16 extend around the entire tank 1 and are of a design that is rigid in the circumferential direction of the tank 1. In addition, the absorbers 15, 16 are designed to be deformable in the radial and axial direction of the tank 1 in such a way that, under the influence of deformations of the upper deck relative to the lower deck, the deformation absorbers can assume a different shape. In the embodiment shown this means that the quadrantal-shaped sections can extend or bulge. By dimensioning the deformation absorbers 15, 16 sufficiently accurately, it can be ensured that said deformation absorbers fully absorb the ship's hull deformations that are to be expected. This means that it is advantageously possible for deformations of the ship's hull to be substantially absorbed by suitable deformations of the deformation absorbers 15, 16, without the tank circumferential wall 3 being placed under a significant load and/or becoming deformed. The tank circumferential wall 3 can consequently be of a thin-walled design, without crumpling or cracking occurring.

The tank bottom 2 and the tank roof 4 are advantageously of a thin-walled design, so that they can easily follow deformations or movements of the lower and upper deck 7, 9.

The support means 12 provide a support in the axial direction of the tank circumferential wall 3.

The deformation absorbers, like the other parts of the tank wall, can be made of steel, in particular stainless steel, for example Duplex 2205 or stainless steel 304. Plastic, in particular fibre-reinforced plastic, could also be used.

During fitting, the deformation absorbers advantageously can be connected under pre-tension, for example can be welded, to the other tank wall parts. This can result in an advantageous load upon the deformation absorbers. It is also conceivable to provide a pre-tension and spring travel limitation in the support means.

The tank bottom, the tank roof and the tank circumferential wall, if made of, for example, ordinary steel or stainless steel, can be made thinner than the general thickness of 25 mm, in particular can be approximately 5-15 mm thick. The thickness of the deformation absorbers can be approximately 5-15 mm. This will be dependent partly on the height-diameter ratio and the material. Partly thanks to this thin-walled design of the tank walls, a saving on material for the transport tanks can be achieved according to the invention.

Figure 2:
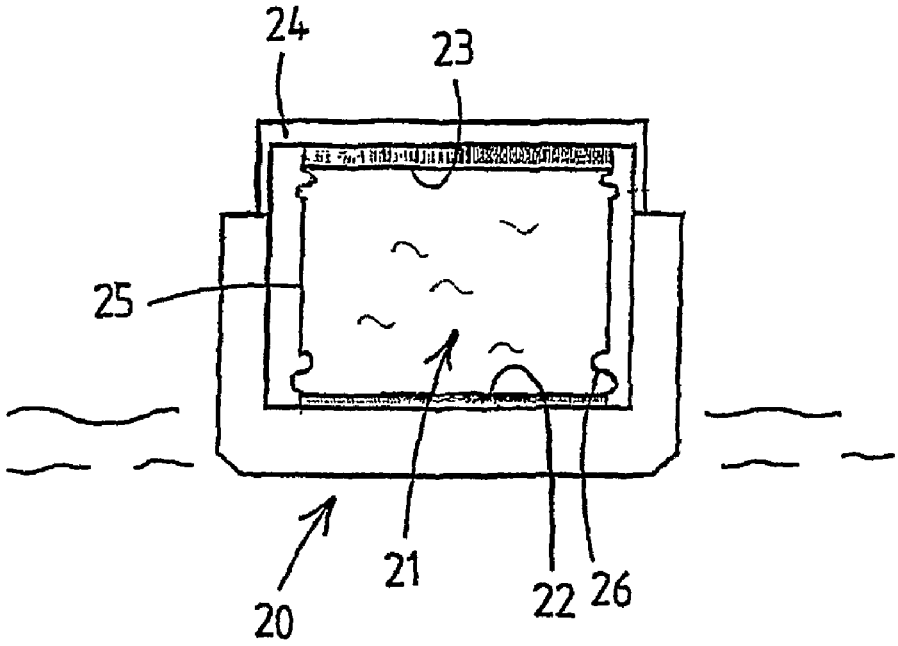
FIG. 2 is a diagrammatic view in cross section of a ship with a variant of a transport tank placed therein.

FIG. 2 shows a ship 20 with a transport tank 21 placed in a hull of said ship. On the lower side the tank 21 is connected by its tank bottom 22 to the bottom of the ship's hull. On the upper side a tank roof 23 of the tank 21 is suspended from an upper deck 24 of the ship's hull. The tank wall further comprises a cylindrical tank circumferential wall 25. Deformation absorbers 26 are accommodated in the tank wall, designed here as bellows-shaped deformation absorbers with two folds extending in the axial direction. The folds extend on either side of an imaginary plane through the tank circumferential wall 25. This has the advantage that the deformation absorber lies symmetrically relative to the tank circumferential wall 25, so that at the position of the deformation absorber no resultant of the liquid pressure occurs in the downward direction. Separate support elements are omitted here.

Figure 3:
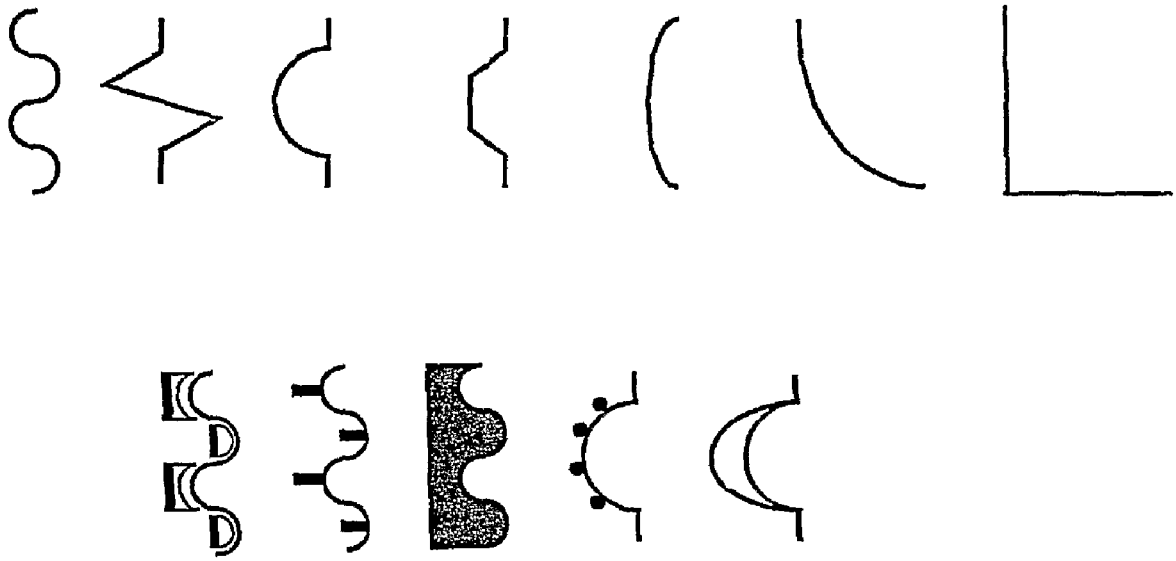
FIG. 3 shows a series of variants of embodiments of deformation absorbers which can be used.

A number of other variants of embodiments of deformation absorbers are shown in FIG. 3. In the case of each of the variants the designer can play as desired with a mutual coordination of wall thickness and choice of material (strength and modulus of elasticity). The five variants at the bottom are provided with means for absorbing pressure forces from the cargo which are exerted upon the deformation absorber. These means are formed here by compressible support elements disposed on the outside of the deformation absorber. Examples here are preformed rubber support blocks, springs, insulating material with limited compressibility, a liquid bag etc. The deformation absorber can be made thinner as a result of this, so that it can absorb even greater deformations.

FIG. 3 also shows variants in which the deformation absorbers are formed by wall parts of the tank circumferential wall or the tank bottom or the tank roof which connect substantially at right angles to each other. If desired, a slight rounding can be provided at the position of the connection. Further, the deformation absorbers may be designed with multiple walls as depicted in the bottom right embodiment of FIG. 3. Deformations of the ship's hull can also be absorbed in particular by designing the wall part of the deformation absorber near the connection to the tank bottom or the tank roof in such a way that said wall part can move up and down slightly, for example by making it thin-walled at that point. Near the connection, spring means can also be provided, which spring means can in particular be under pre-tension, and in particular operate in the axial direction of the tank.

Figure 4:
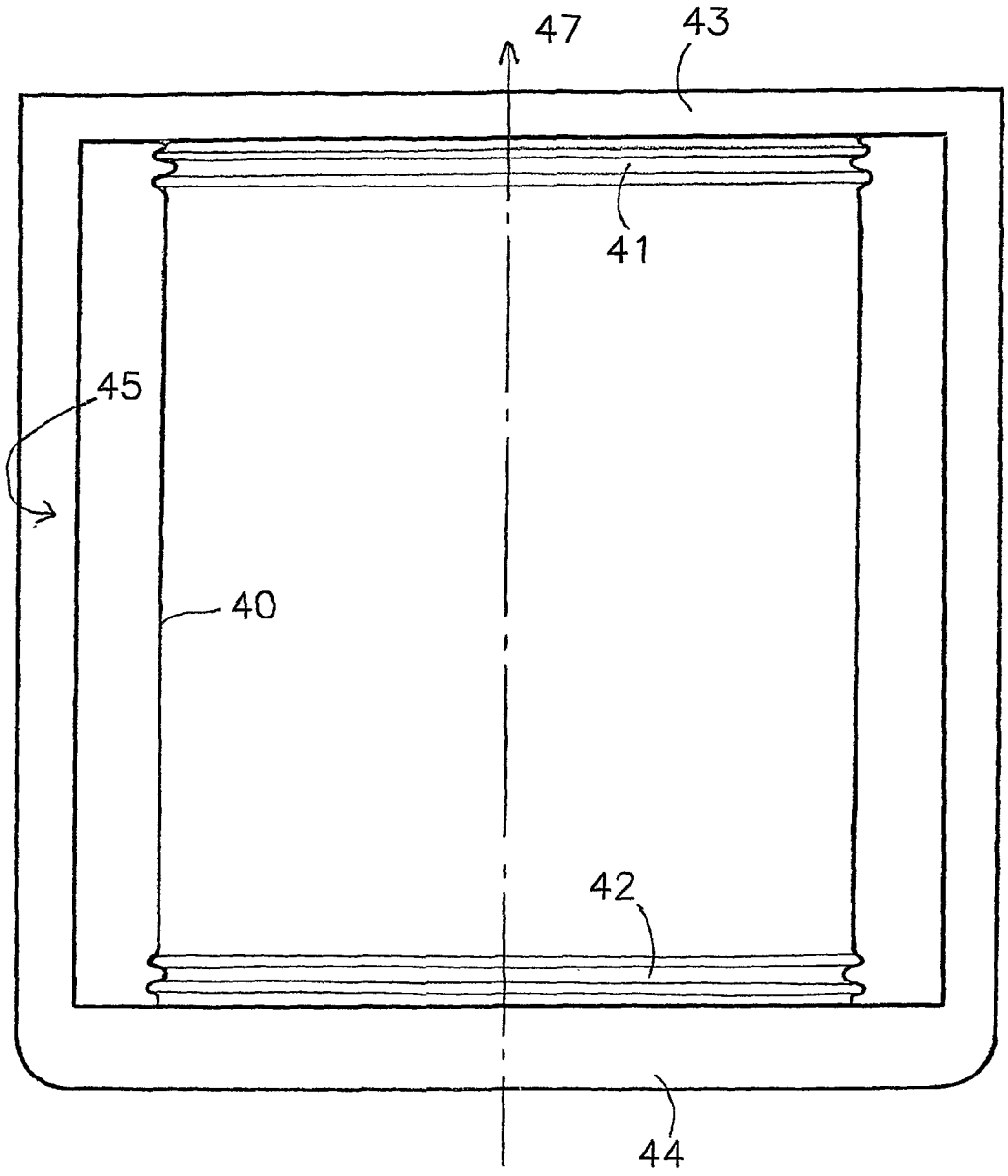
FIG. 4 is a front view of a variant of FIG. 2.
Figure 5:
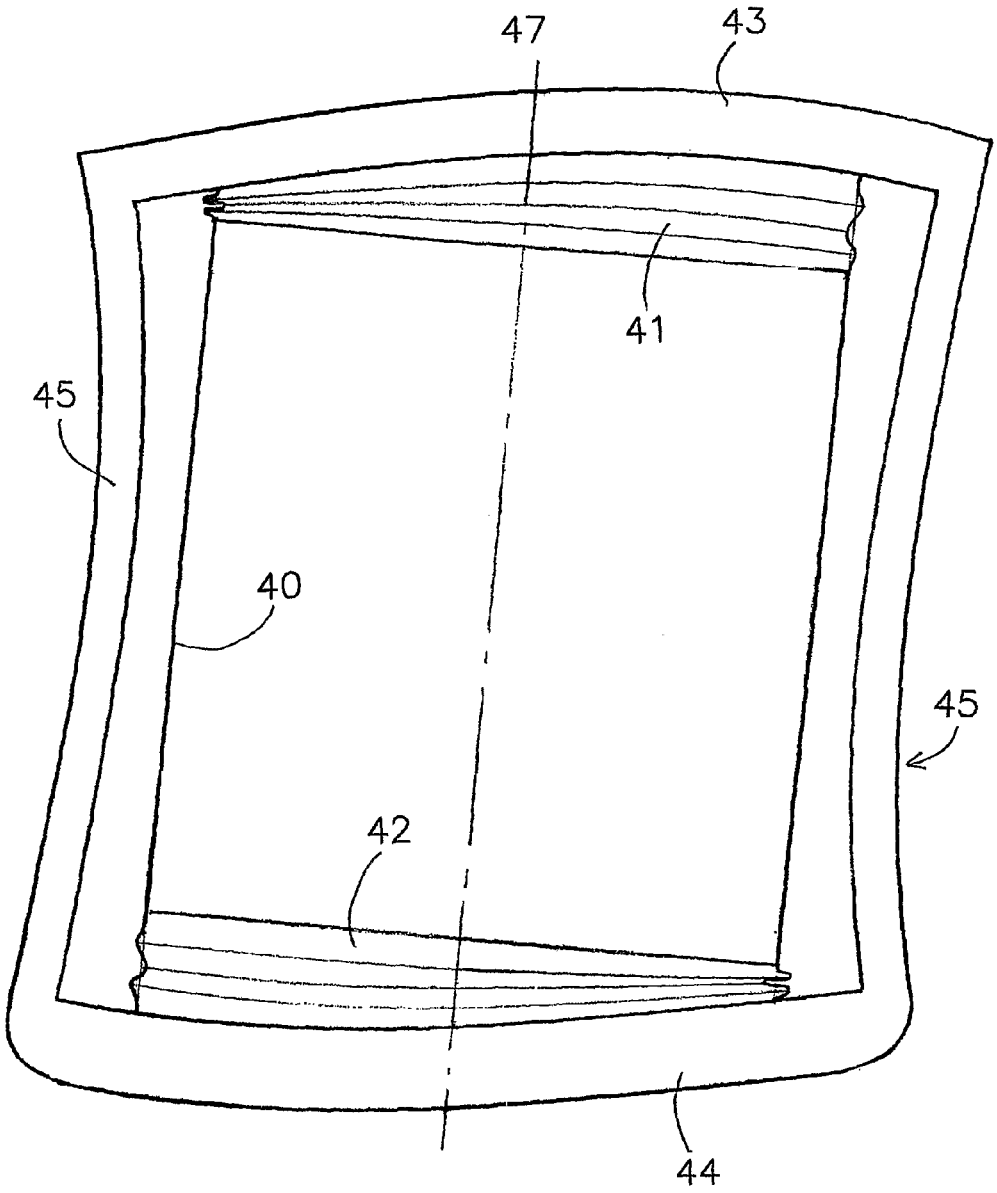
FIG. 5 shows the variant in FIG. 4 in a deformed state.
Figure 6:
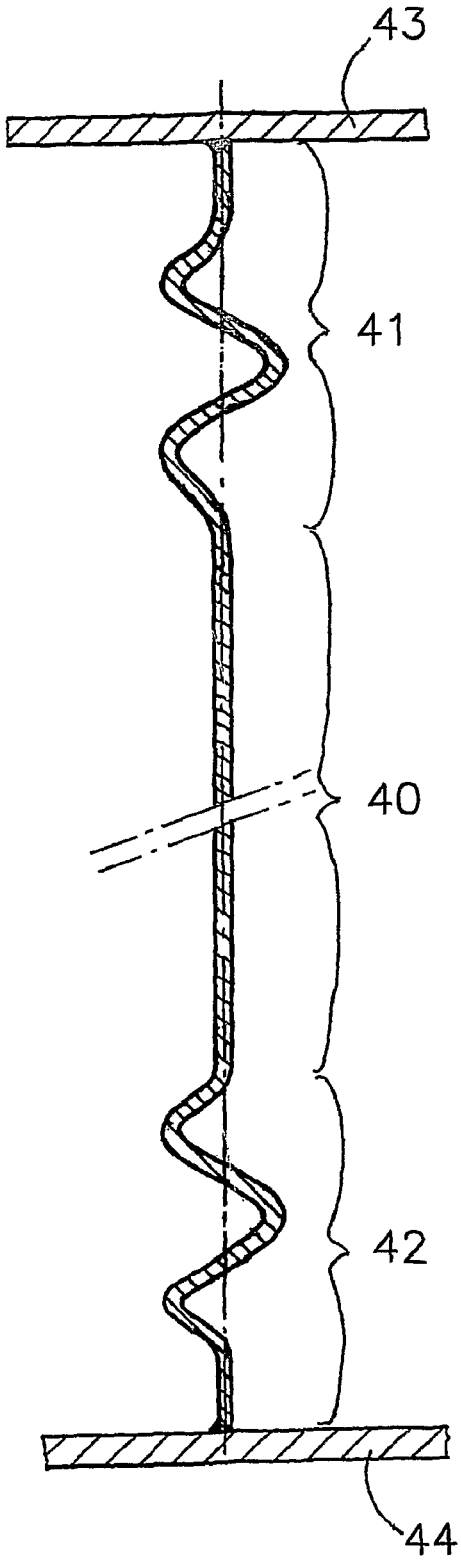
FIG. 6 is a partial view in cross section of FIG. 4.

In FIGS. 4-6 a tank circumferential wall 40 is suspended directly by means of two deformation absorbers 41, 42 from an upper deck 43 and a lower deck 44 of a ship's hull 45. The tank bottom and the tank roof here form an integral part of the lower deck 44 and upper deck 43 respectively. The deformation absorbers 41, 42 are both of a bellows-shaped design, extend in the circumferential direction along the entire tank circumferential wall 40, and form a continuous sealing connection between the tank circumferential wall 40 and the tank bottom and the tank roof respectively. The tank circumferential wall 40 is of a cylindrical design here. FIG. 5 shows clearly that if there is a deformation of the ship's hull 45, in this case a combination of a twisting and a bending of the lower deck, the walls and the upper deck of said ship, this deformation is fully absorbed by the deformation absorbers 41, 42. Said deformation absorbers are compressed or extended locally in the axial direction, in other words parallel to the centre line 47 of the tank circumferential wall 40. The tank circumferential wall 40 is subjected to little or no extra load by this and can consequently retain substantially its original shape.

Figure 7:
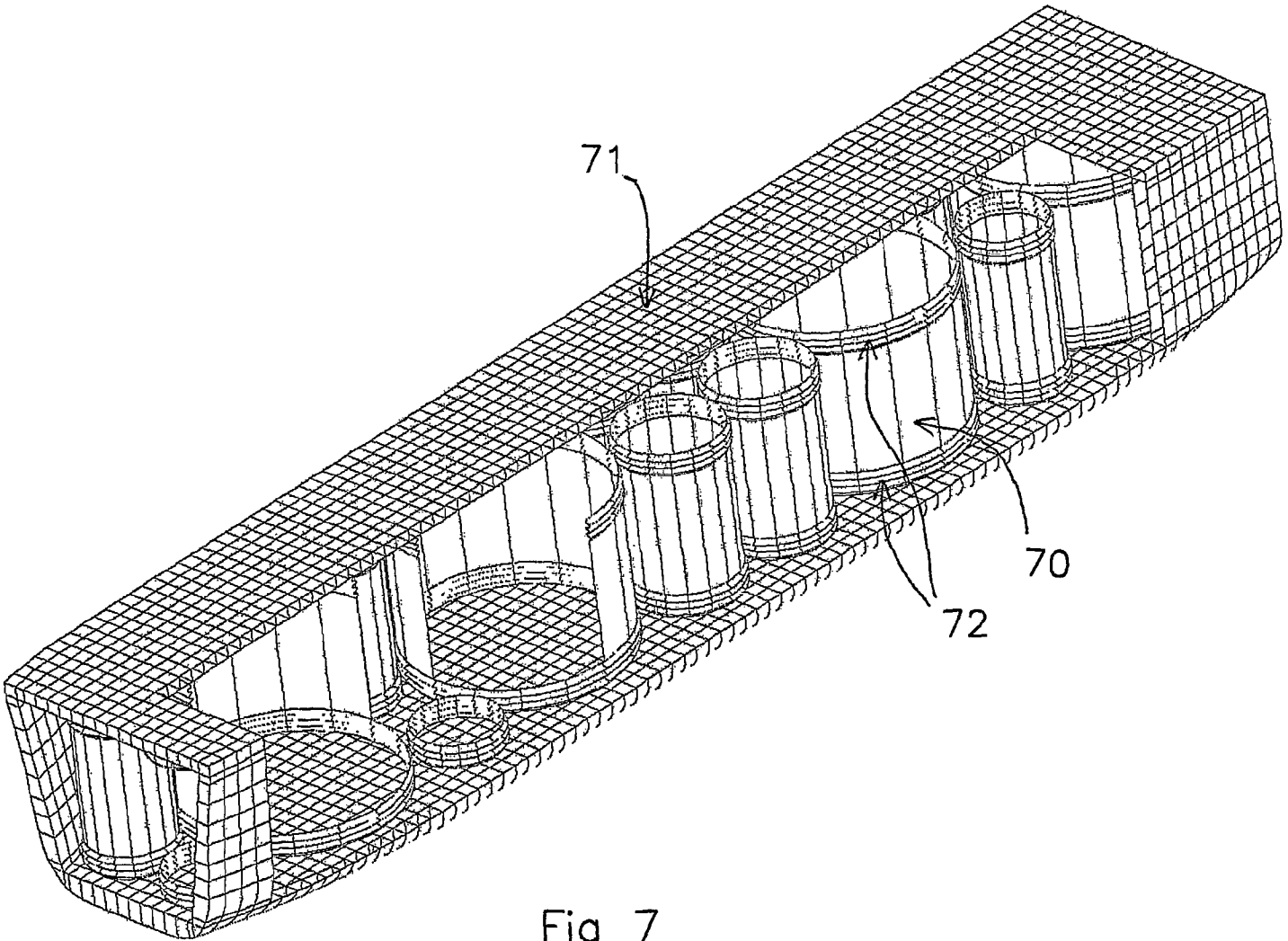
FIG. 7 is a cut-away view in perspective of a ship's hull with several transport tanks according to FIG. 4 placed therein.

FIG. 7 shows several transport tanks 70 according to the invention provided in a ship's hull 71. The tanks 70 have different dimensions and can consequently utilize the free space in the ship's hull 71 to the full. In addition, the tanks 70 are disposed with their circumferential walls clear of each other and of the ship's hull. It can be seen clearly that the deformation absorbers 72 extend around the entire tank and form an integral part of the tank wall.

In the following figures identical and similar parts are indicated by the same reference numerals as far as possible.

Figure 8:
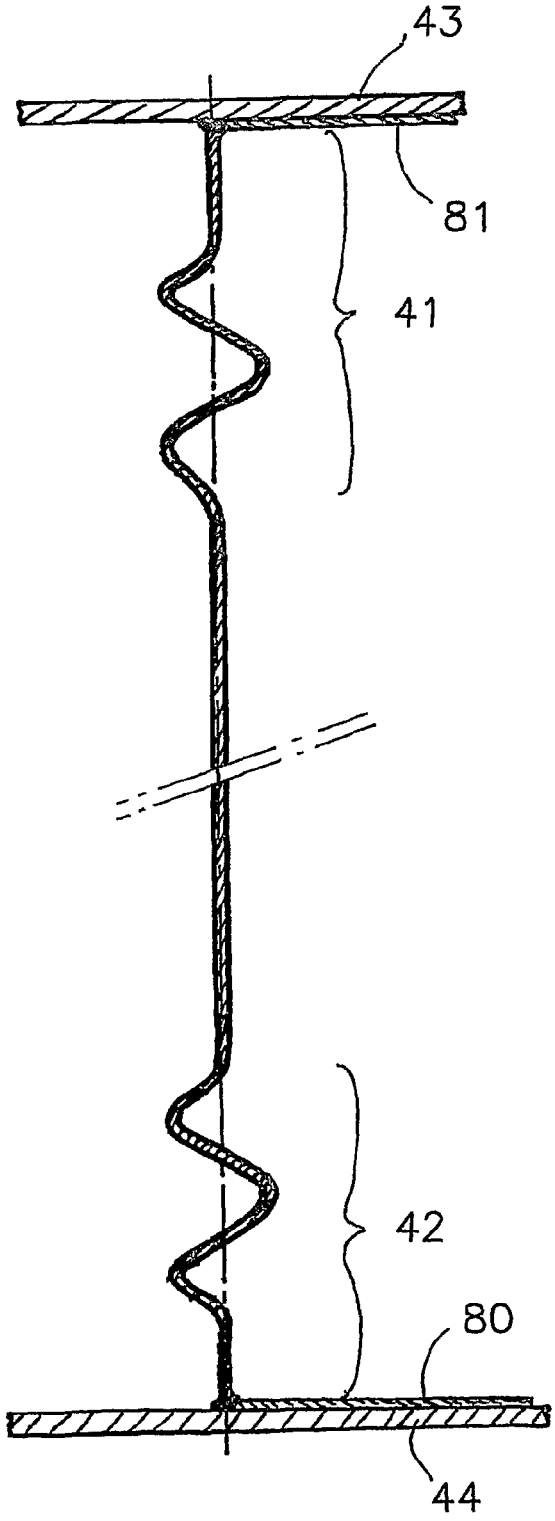
FIGS. 8-14 show variants of FIG. 6.

FIG. 8 shows a variant of FIG. 6 in which the tank bottom 80 and the tank roof 81 are designed as separate parts. Both are fully supported on the lower and upper decks 44 and 43 respectively. The deformation absorbers 42, 41 are permanently connected to the tank bottom 80 and the tank roof 81 respectively and/or to the lower and upper decks 44 and 43 respectively.

Figure 9:
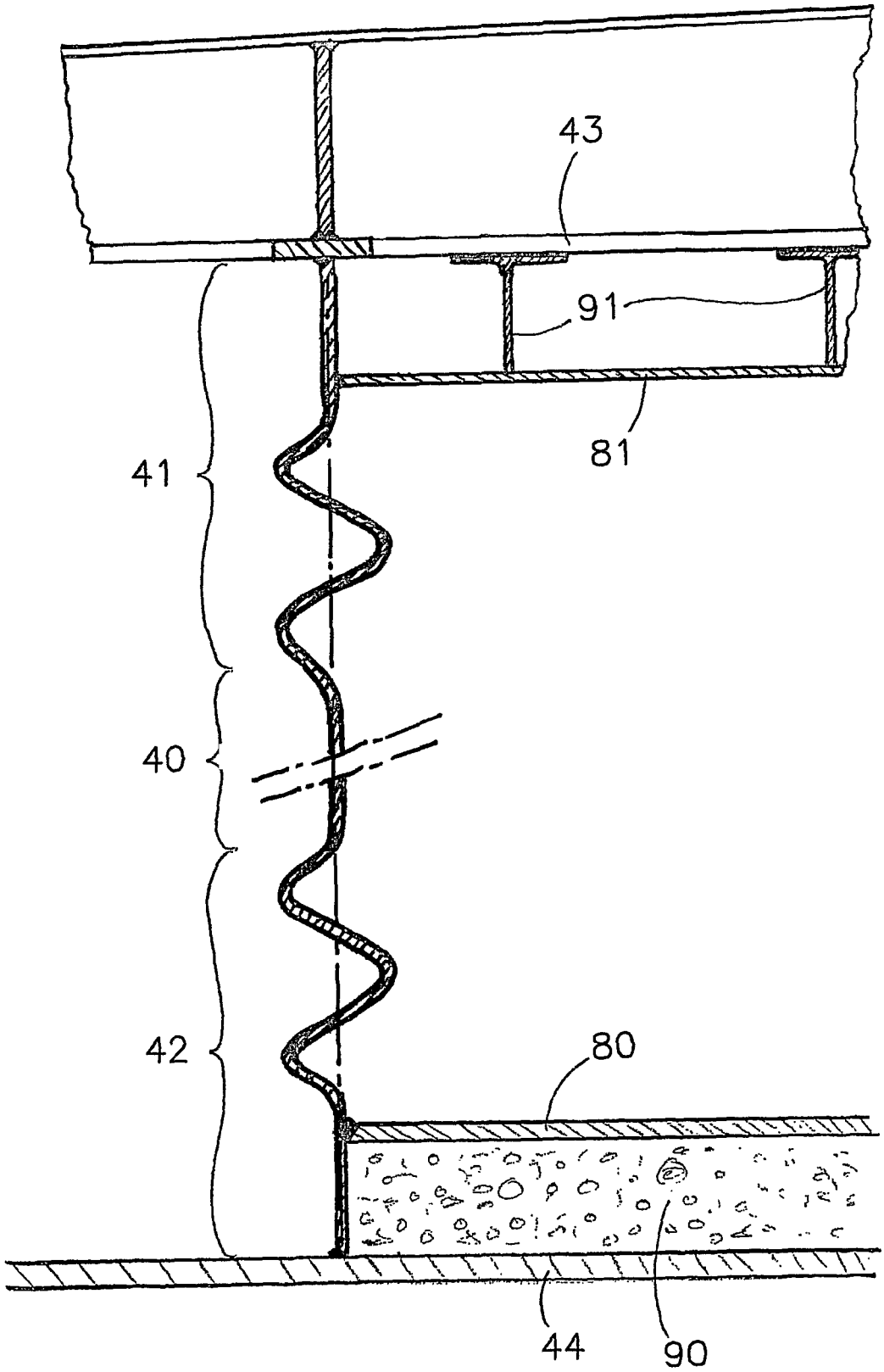

FIG. 9 shows a variant of FIG. 8 in which the tank bottom 80 is supported by way of a slightly compressible layer 90, for example a cork layer or a sandwich layer, on the lower deck 44. The lower deformation absorber 42 is connected both to the tank bottom 80 and to the lower deck 44. The tank roof 81 is supported on the upper deck 43 by means of sections 91. The upper deformation absorber 41 is connected here both to the tank roof 81 and to the upper deck 43.

Figure 10:
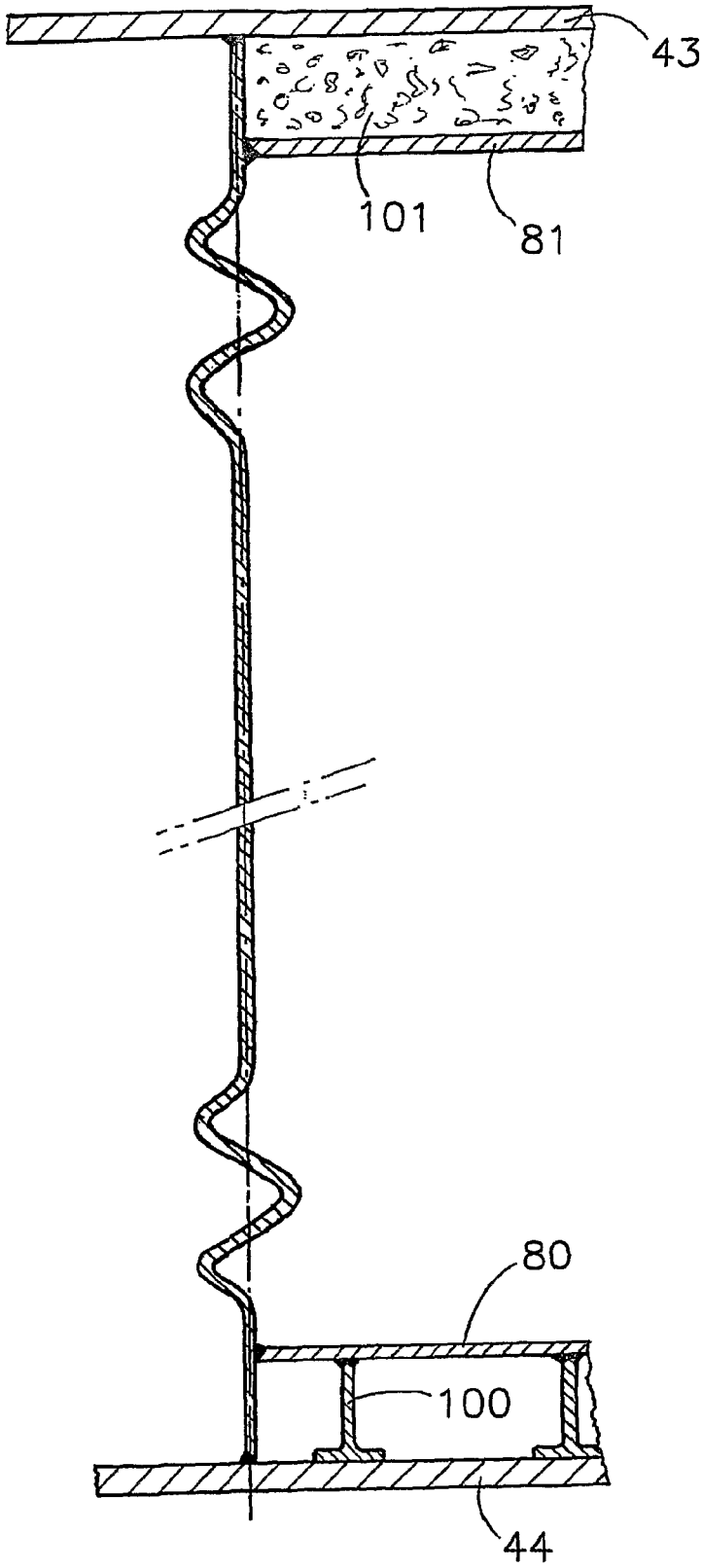

FIG. 10 shows a variant of FIG. 9 in which the tank bottom 80 is now supported on the lower deck 44 by means of sections 100, while the tank roof is connected by means of a slightly compressible layer 101 to the upper deck 43.

Figure 11:
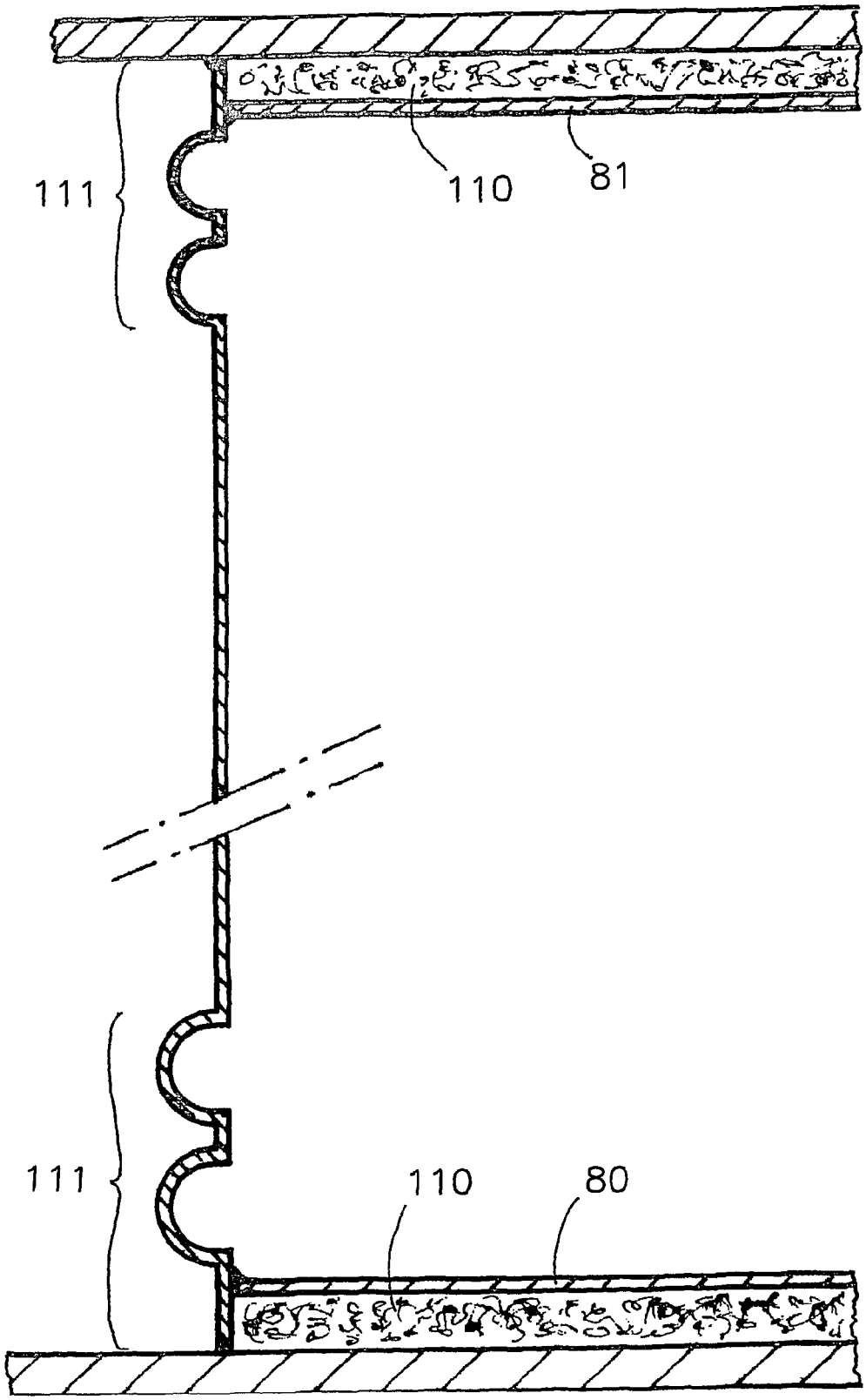

FIG. 11 shows a variant in which both the tank bottom 80 and also the tank roof 81 are supported on a compressible layer 110. The deformation absorbers 111 are formed here by double semi-circular deformation sections.

Figure 12:
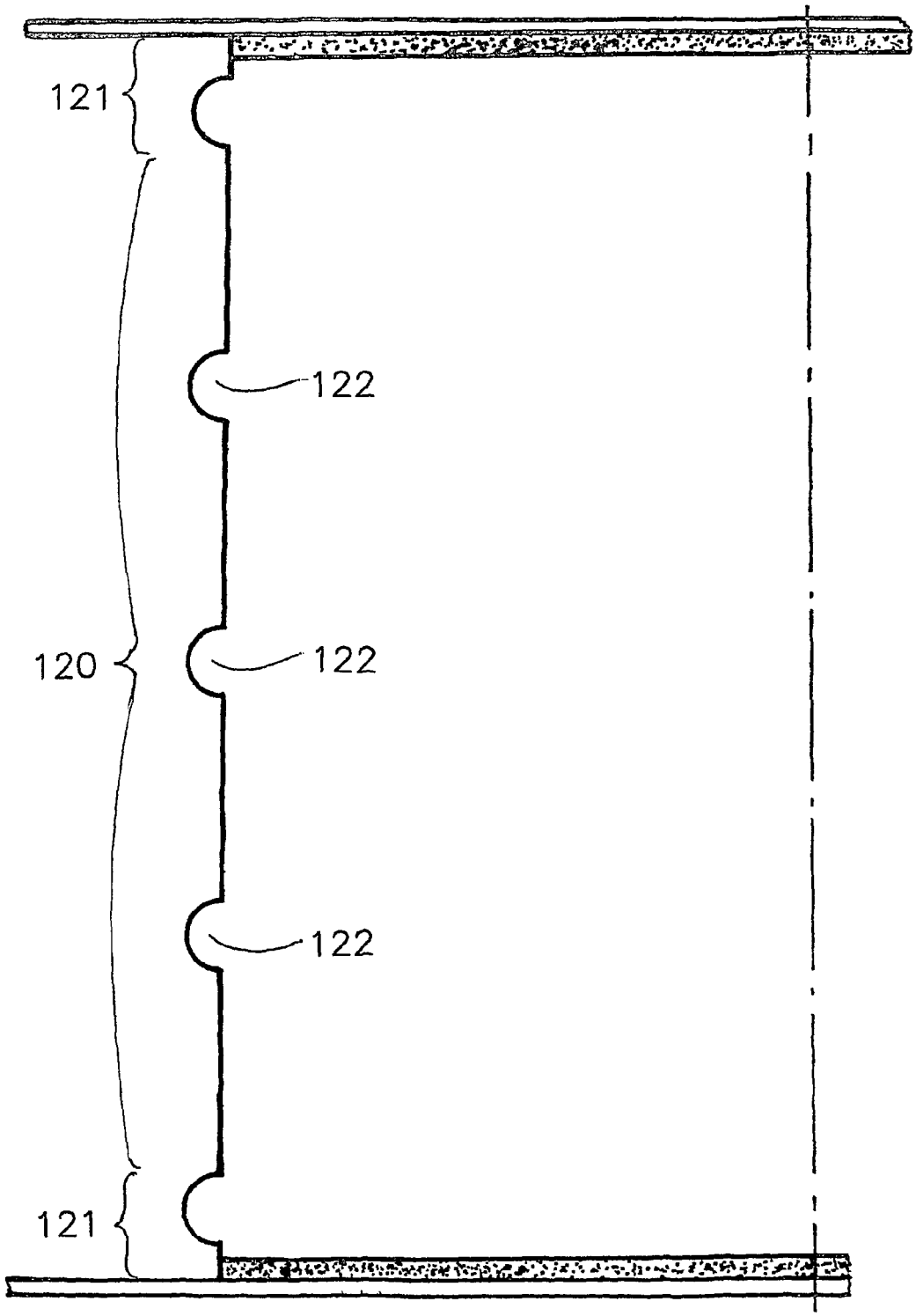

FIG. 12 shows a variant in which a tank circumferential wall 120 is suspended between upper and lower semi-circular deformation sections 121. In addition, yet further deformation absorbers 122 are integral with the tank circumferential wall 120. Said deformation absorbers are of the same shape here as the deformation sections 121.

Figure 13:
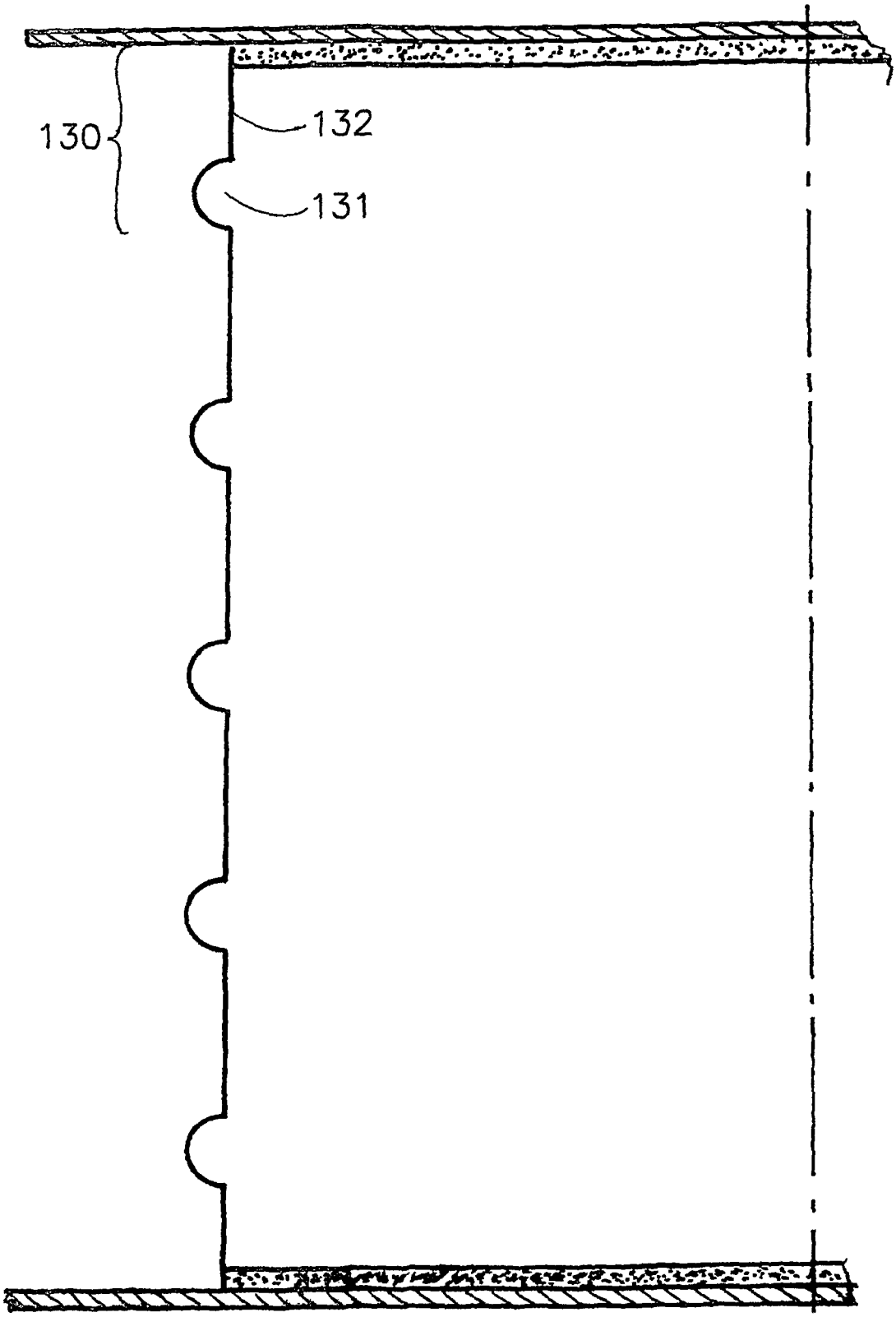

FIG. 13 shows a variant in which the lower and upper deformation absorbers 130 comprise semi-circular section parts 131, which merge into straight section parts 132 in the direction of the lower and upper deck respectively.

Figure 14:
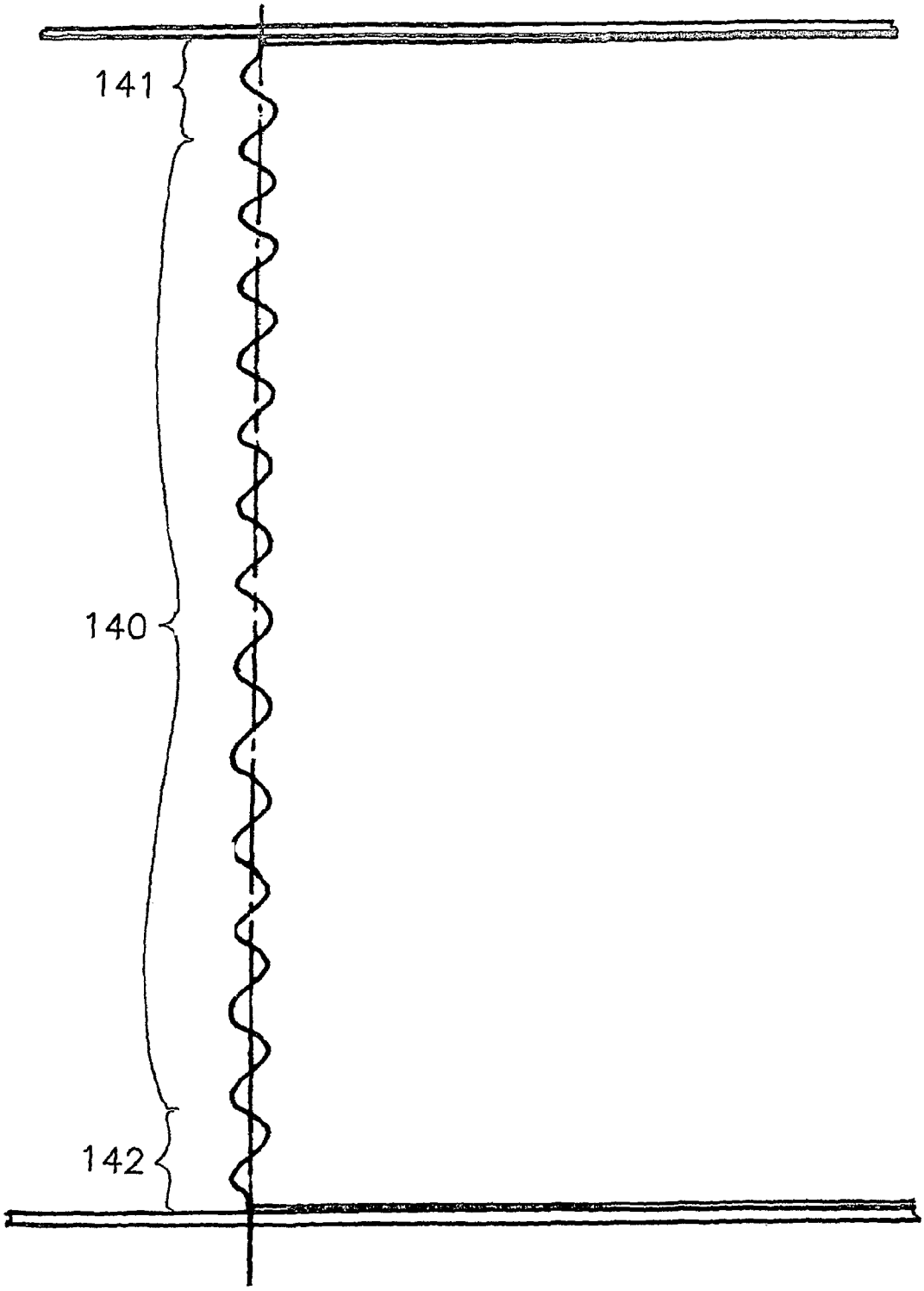

FIG. 14 shows a variant in which the entire tank circumferential wall 140 is made up of interconnecting bellows-shaped section parts. Upper and lower section parts here form the deformation absorbers 141, 142 between which the tank circumferential wall 140 is suspended.

Figure 15:
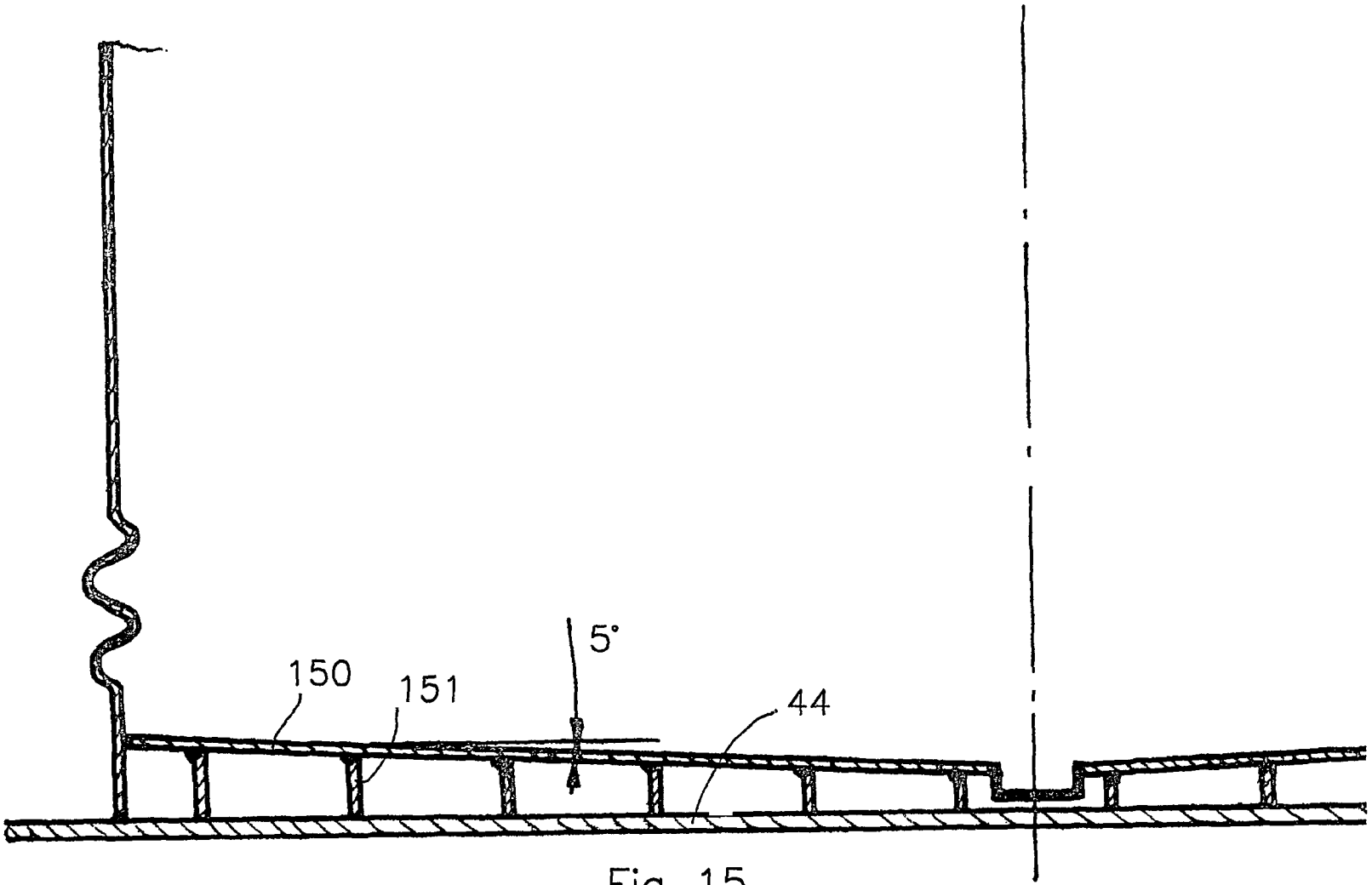
FIG. 15 shows a variant with slanting tank bottom.

FIG. 15 shows a variant of FIG. 10 in which a tank bottom 150 which slants down towards the centre is supported by way of sections 151 on the lower deck 44. The tank bottom 150 here has an angle of inclination of, for example, 5 degrees relative to the lower deck 44. The advantage of this is that the tank is easier to empty and clean.

Figure 16:
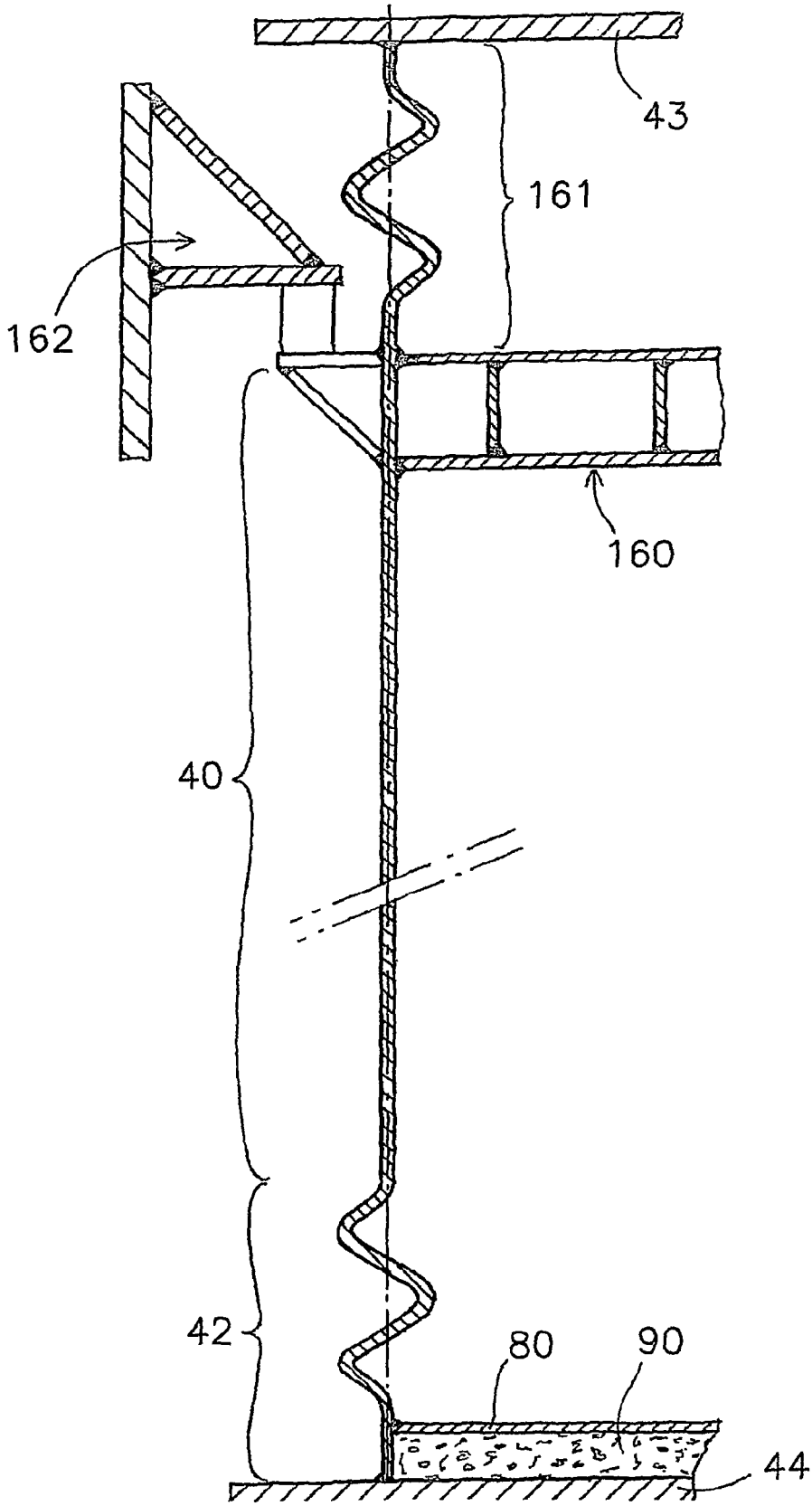
FIGS. 16-18 show variants with an upper deformation absorber provided fully or partially outside the tank wall.

FIG. 16 shows a variant of FIG. 9 in which a rigid tank roof 160 is supported on the tank circumferential wall 40. The tank circumferential wall 40 and the tank roof 160 are suspended by means of a deformation absorber 161 from the upper deck 43. The deformation absorber 161 thus does not form part of the tank wall which has to bound the liquid in the tank. Furthermore, one or more separate support elements 162 are provided, by means of which movement of the tank circumferential wall 40 upwards can be limited. This movement upwards can occur, for example, as a result of liquid pressure against the tank roof 160.

Figure 17:
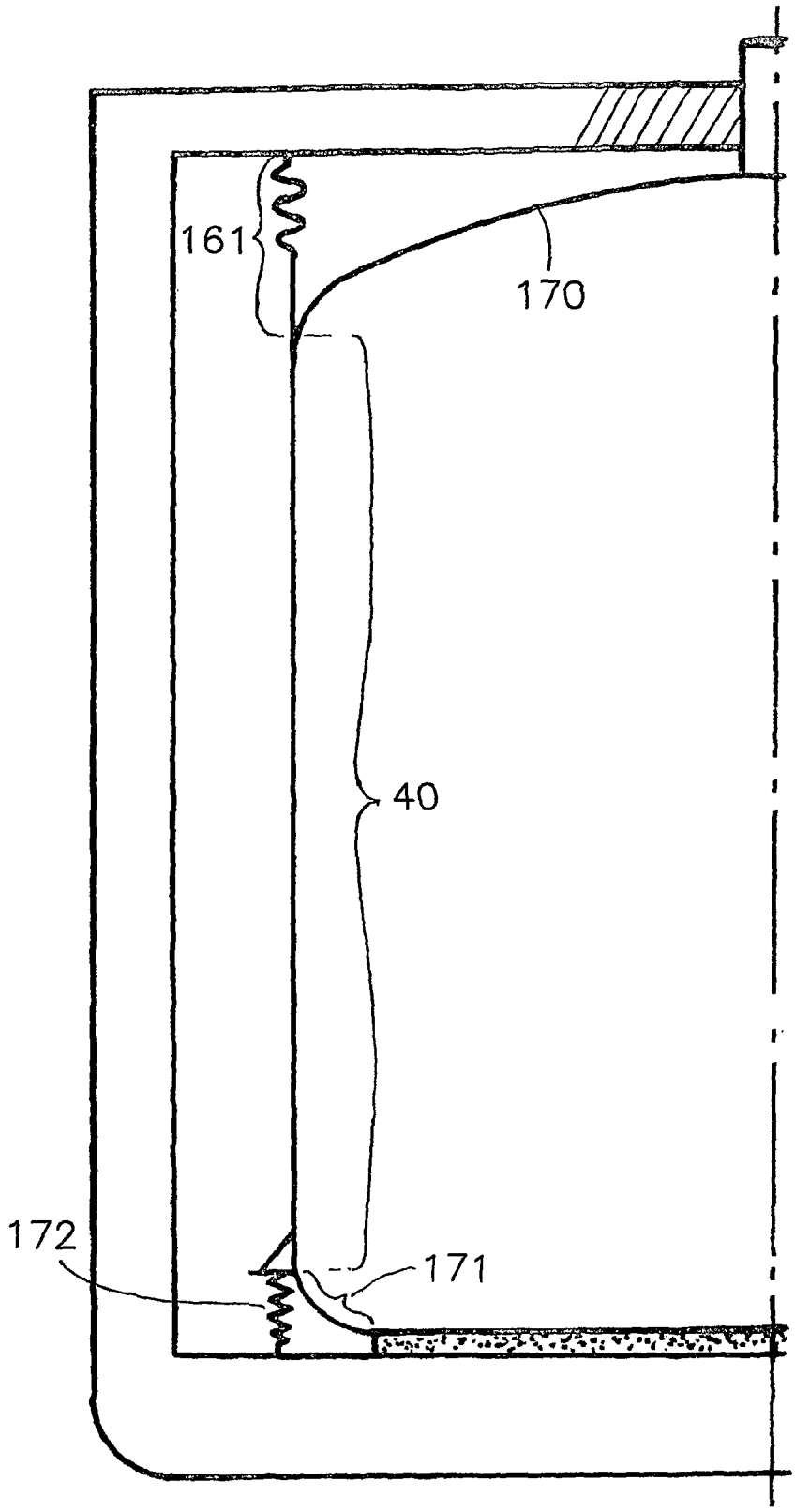

FIG. 17 shows a variant of FIG. 16 in which the tank roof is formed by a dome-shaped roof 170 which is supported directly on the tank circumferential wall 40. The lower deformation absorber 171 is formed by a quadrantal-shaped section. The support elements 162 are omitted here. However, the lower end of the tank circumferential wall is connected to support elements 172. The support elements 172 preferably comprise tension and compression springs in order to prevent compression of the deformation absorber 171 as a result of liquid pressure upon it, and in order to minimize movements of the tank circumferential wall 40 upwards as a result of liquid pressure on the tank roof 170.

Figure 18:
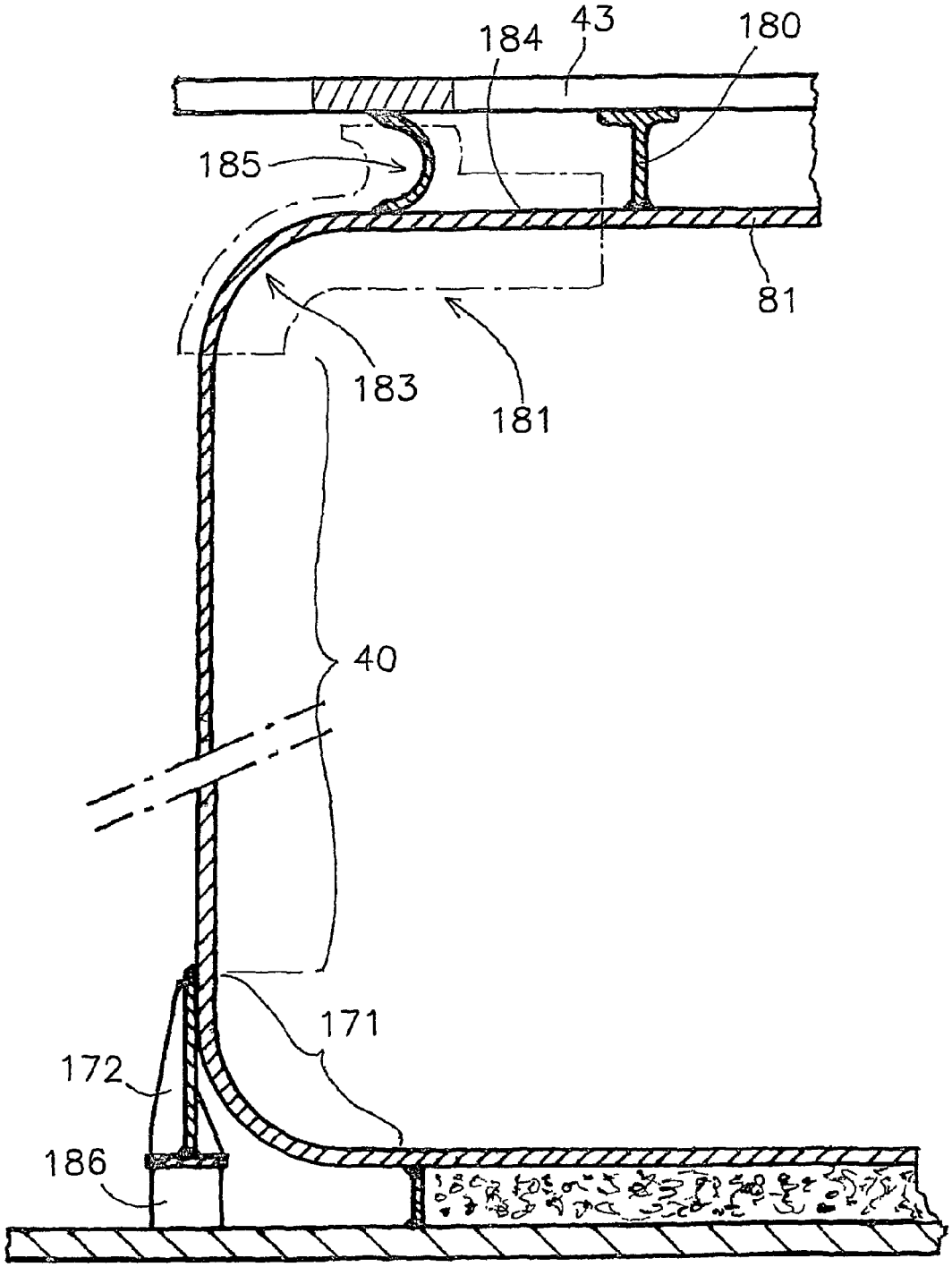

FIG. 18 shows a variant in which the tank roof 81 is suspended from the upper deck 43 by means of sections 180. The tank circumferential wall 40 is suspended between the lower deformation absorber 171 and an upper deformation absorber 181. The upper deformation absorber 181 is partially integral with the tank wall and extends partially beyond it between the tank and the upper deck 43. The integral part comprises a quadrantal-shaped deformation section 183 and a horizontal part 184. The part lying outside the tank wall comprises a semi-circular deformation section 185. The support element 172 is designed here with rubber blocks or a continuous rubber connection 186.

Figure 19:
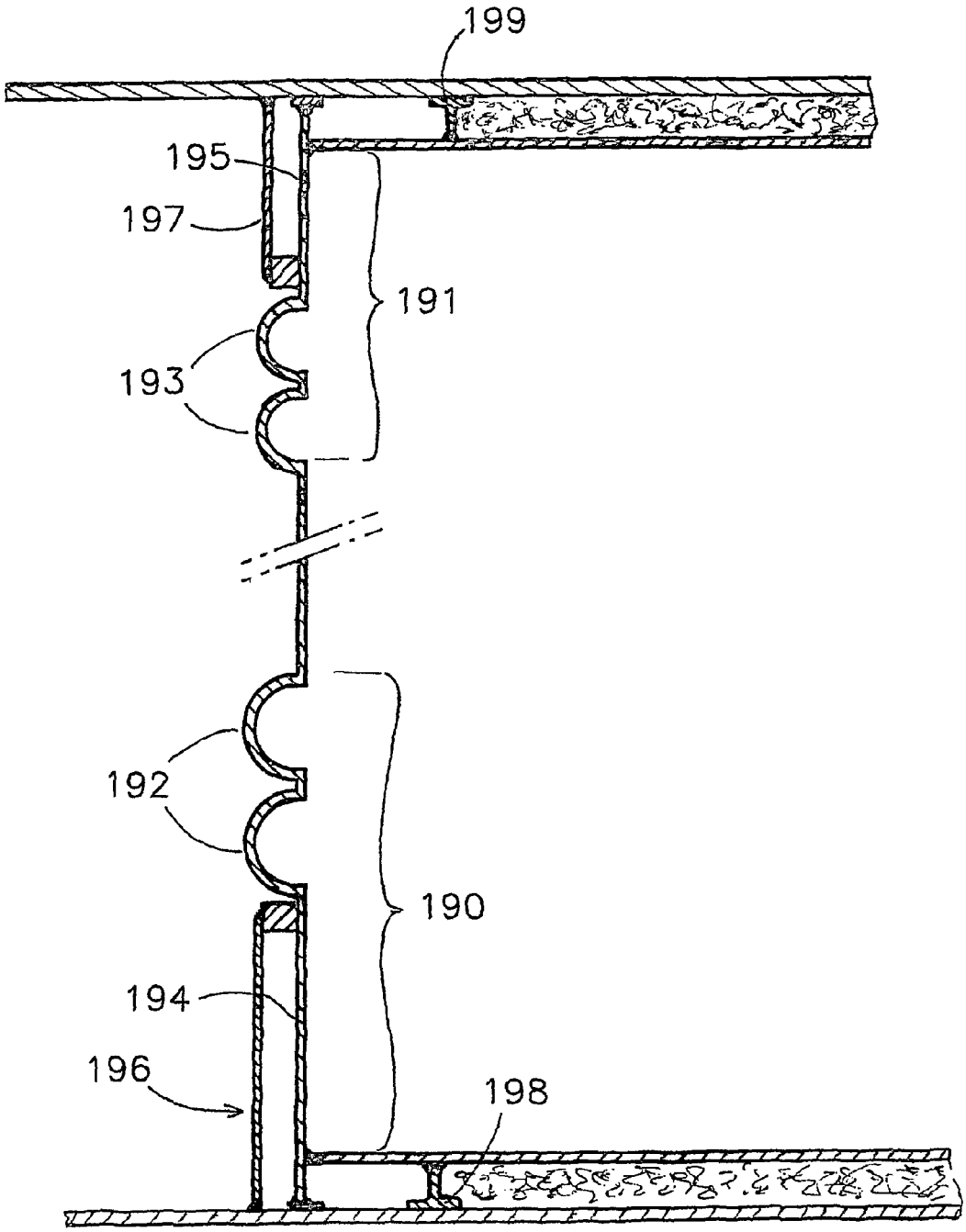
FIGS. 19 and 20 show variants with an additional skirt construction.

FIG. 19 shows a variant in which the deformation absorbers 190, 191 each comprise a double semi-circular deformation section part 192, 193 and a straight wall part 194, 195, both forming part of the tank wall. In addition, skirt walls 196, 197 are provided, said skirt walls on one side being connected to the deformation absorbers 190, 191 and on the other side being fixed to the lower and upper deck respectively, so that expansion in the radial direction of the tank wall as a result of temperature differences can be absorbed. This is necessary here because the tank bottom and the tank roof are supported in the axial direction on sections 198, 199 which can slide in the horizontal direction relative to the lower deck and the upper deck. Likewise, the lower and upper sides respectively of the deformation absorbers 190, 191 are not connected in a fixed, but in a slidable manner to the lower and upper decks respectively. In the horizontal direction the tank in this variant is supported only by the skirt walls 196, 197. The skirt walls 196, 197 preferably extend around the entire circumference of the tank.

Figure 20:
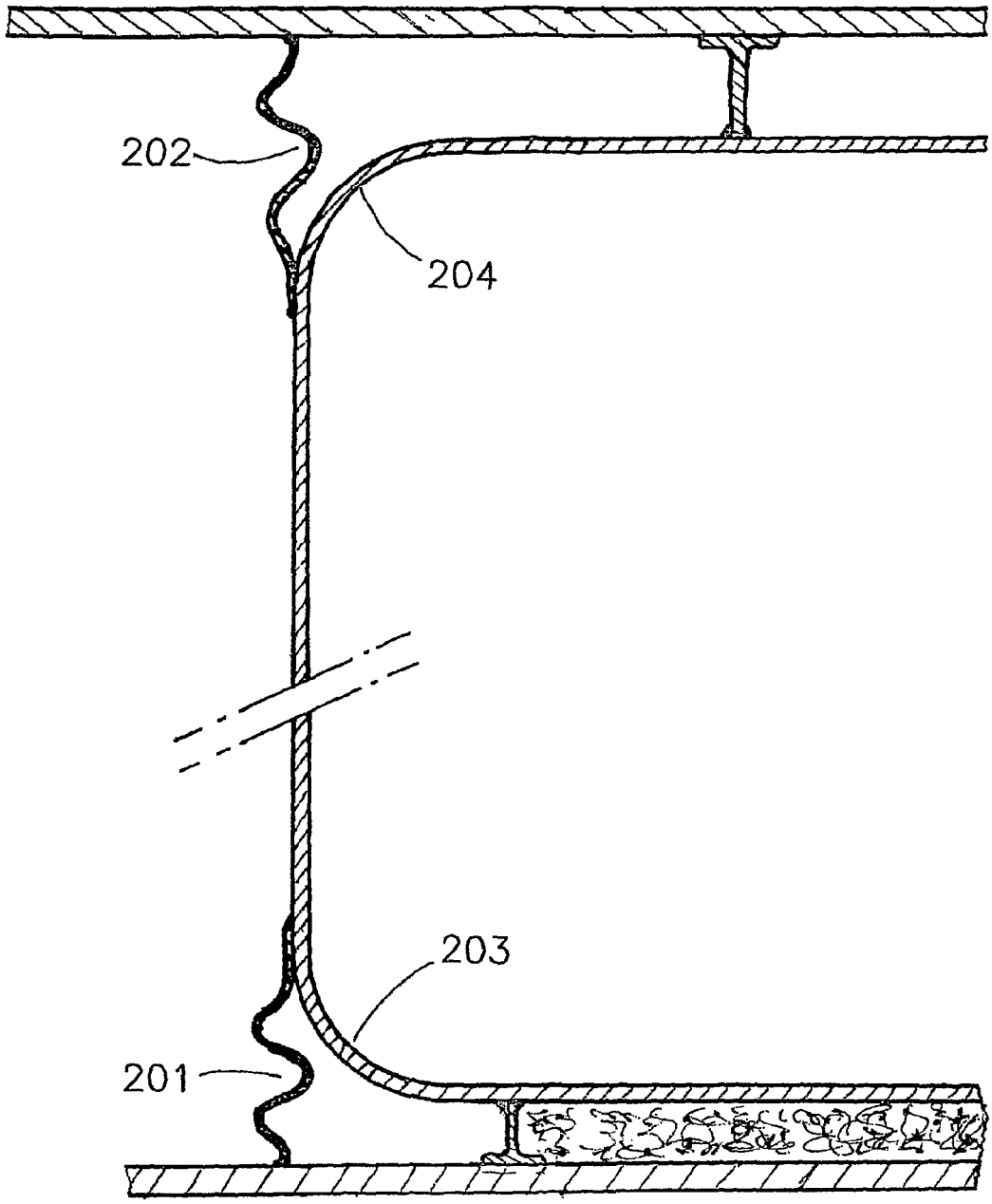

FIG. 20 shows a variant of FIG. 19, in which the skirt walls 201, 202 are designed in such a way that they can absorb deformations in the radial and axial direction and can support the tank wall in the axial direction. With proper dimensioning of the rigidity in the axial direction, no additional support means are then needed. In the circumferential direction the skirt walls 201, 202 are again relatively rigid, so that they can hold the tank in place. The deformation absorbers are further formed here by quadrantal-shaped sections 203, 204 incorporated in the tank wall. Just as in FIG. 19, the tank bottom and the tank roof here too are supported so as to be slidable in the horizontal direction on the lower and upper decks respectively.

Figure 21:
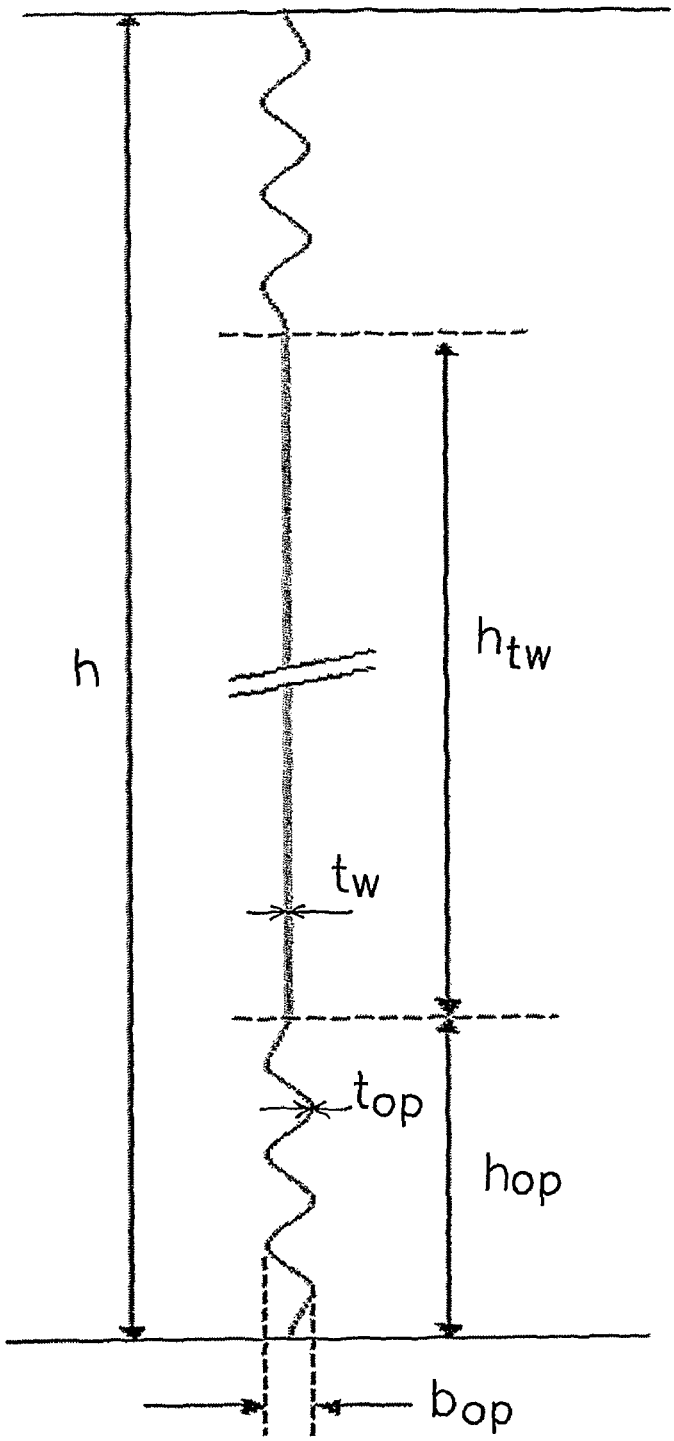
FIG. 21 shows diagrammatically the variant of FIG. 6 with parameters indicated therein.

In the following numeric example with reference to FIG. 21 we assume a cylindrical stainless steel tank, with the following data:

| | |
|---|---|
| Tank height | h = 7000 mm |
| Tank radius | r = 5000 mm |
| Wall thickness of tank circumferential wall | $t_w$ = 5 mm |
| Density of stainless steel | $\rho_{stainless\ steel}$ = 7950 kg/mm$^3$ |
| Modulus of elasticity of stainless steel | E = 200000 N/mm$^2$ |
| Gravitational acceleration | g = 9.81 m/s$^2$ |
| Permissible tension of stainless steel | $\sigma_{toe}$ = 240 N/mm2 |

The two deformation absorbers are of the same shape and have the following dimensions:

| | | |
|---|---|---|
| Height of deformation absorber | $h_{op}$ = 1000 | mm |
| Breadth of deformation absorber | $b_{op}$ = 100 | mm |
| Wall thickness of deformation absorber | $t_{op}$ = 4 | mm |
| Height of tank circumferential wall | $h_{tw}$ = 5000 | mm |

The following characteristics of a single deformation absorber have been determined by means of a FEM calculation:

$$\text{Deformation capacity: } D_{p_{max}} = 12.1 \text{ mm}$$

$$\text{Axial rigidity: } C_p = 1.22\frac{\text{N/mm}}{\text{mm}}$$

The theoretical sinkage of the tank wall at the position halfway up, disregarding the rigidity of the tank wall itself, is:

$$\text{sinkage} = \frac{G_{tw}}{2 \cdot C_p}$$

With:

$$G_{tw} = \text{Weight of tank circumferential wall in N per mm circumference}$$

$$C_p = \text{Rigidity of one deformation absorber in N/mm/mm}$$

$$G_{tw} = t_w \cdot h_w \cdot \rho_{stainless\ steel} \cdot g = 0.005 \cdot 5 \cdot 7950 \cdot 9.81 = 1950\frac{\text{N}}{\text{m}} = 1.95\frac{\text{N}}{\text{mm}}$$

$$\text{Sinkage} = \frac{G_{tw}}{2 \cdot C_p} = \frac{1.95}{2 \cdot 1.22} = 0.80 \text{ mm}$$

The minimum sinkage of the tank wall according to the following formula should be:

$$C \cdot h \cdot \sqrt{r} = 1 \cdot e^{-7} \cdot 7000 \cdot \sqrt{5000} = 0.05 \text{ mm}$$

The tank wall therefore sinks more than 15 times further than the minimum value according to the above formula.

Since the rigidity in the axial direction of the deformation absorbers is the same, these deformation absorbers absorb equal deformation when there is movement of the upper deck relative to the lower deck. The deformation capacity of the total wall, disregarding the deformation capacity of the tank circumferential wall, is then:

$$D_{tot} = 2 \cdot D_{p_{max}} = 2 \cdot 12.1 = 24.2 \text{ mm}$$

The tank circumferential wall together with the deformation absorbers should then be able to withstand a movement of the upper deck relative to the lower deck of at least: Y*h/1000=1*7000/1000=7 mm. The tank circumferential wall together with the deformation absorbers can therefore absorb at least 3.4 times more deformation than the minimum calculated value.

The axial rigidity of the tank circumferential wall together with the deformation absorbers is compared below with that of a reference wall. Said reference wall:

- is straight all the way down;
- is made of the same material as the circumferential wall of the tank and the deformation absorbers;
- has the same wall thickness curve as the circumferential wall of the tank and the deformation absorbers.

In general, it can be said that the axial rigidity of the reference wall can be determined as follows:

$$C_w = \frac{N}{\delta_w}$$

With:

$C_w$=Rigidity of the reference wall in the axial direction expressed in Newton per millimeter of compression per millimeter of circumference. [N/mm$^2$]

N=Edge load expressed in Newton per mm of circumference [N/mm]

$\delta_w$=Compression of the reference wall at particular edge load in millimeters [mm].

If the tank circumferential wall and the deformation sections are made of a uniform material and all have an equal and uniform wall thickness, the rigidity of the reference wall is equal to:

$$C_w = \frac{E \cdot t_w}{\delta_w}$$

With:

$C_w$=Rigidity of the reference wall in the axial direction [N/mm$^2$]

E=Modulus of elasticity in [N/mm$^2$]

$t_w$=thickness of the (uniform) reference wall in [mm]

$h_w$=Height of the reference wall in [mm] is equal to the tank height.

If the tank circumferential wall and the deformation sections have different wall thicknesses and are made of different materials, the following applies as regards the axial rigidity of the reference wall:

$$C_w = \frac{1}{\frac{h1}{E_1 \cdot t_1} + \frac{h2}{E_2 \cdot t_2} + \ldots + \frac{h_n}{E_n \cdot t_n}}$$

The reference wall in that case is divided into N cylindrical wall parts, each with its own wall thickness, its own height and its own modulus of elasticity. This means that we can determine the rigidity of the reference wall according to the numeric example as follows:

$$C_w = \frac{1}{\frac{1000}{200000\cdot 4} + \frac{5000}{200000\cdot 5} + \frac{1000}{200000\cdot 4}} = 133 \text{ N/mm/mm}$$

The rigidity of the tank circumferential wall with the deformation absorbers is $C_{wp}$. This rigidity is defined as follows:

$$C_{wp} = \frac{N}{\delta_{wp}}$$

The rigidity can be calculated as follows:

$$C_w = \frac{1}{\frac{1}{C_p} + \frac{1}{C_{tw}} + \frac{1}{C_p}} = \frac{1}{\frac{1}{1.22} + \frac{5000}{200000\cdot 5} + \frac{1}{1.22}} = 0.61 \text{ N/mm/mm}$$

This makes the ratio between the axial spring rigidity of the reference wall and that of the tank circumferential wall with deformation absorbers:

$$\frac{C_w}{C_{wp}} = \frac{133}{0.61} = 219$$

The minimum value of this ratio according to one embodiment is greater than or equal to 2, so that the rigidity ratio in this example is over 100 times greater.

According to a preferred embodiment, the rigidity of at least one of the deformation absorbers is lower than or equal to 20 N/mm/mm. The rigidity of both deformation absorbers is 1.22 N/mm/mm here, and is therefore less than 20.

According to another preferred embodiment, the wall thickness of the tank circumferential wall should be less than X. For X the following applies:

$$X = \text{maximum of: } \frac{K}{(\sigma_{toe})^{\frac{3}{4}}} \cdot \sqrt{h\cdot D} \text{ and } Z,$$

with: K>=0.15, Z>=10, $\sigma_{toe}$=the permissible tensile stress in the tank circumferential wall in N/mm$^2$, h=height of the tank in millimeters, and D=the diameter of the tank circumferential wall in millimeters.

$$X = \max\left[\left(\frac{0.15}{\sigma_{toe}^{\frac{3}{4}}} \cdot \sqrt{h\cdot d}\right) \text{ and } (10)\right]$$

$$\frac{0.15}{200^{\frac{3}{4}}} \cdot \sqrt{7000\cdot 10000} = 23.6 \text{ mm}$$

$$X = \max[23.6 \text{ and } 10] = 23.6 \text{ mm}$$

The wall thickness of the tank circumferential wall is 5 mm and is therefore less than 23.6 mm.

Depending on the material selected for the deformation absorbers, depending on whether or not they form an integral part of the tank wall, and depending on the cargo to be transported, said absorbers can further be clad with a chemical-resistant coating or lining, such as a layer of stainless steel.

Many variants are possible apart from the embodiments shown. For example, the various aspects from the figures can be combined further with each other. The tank bottom or the tank roof can be of a shape other than flat, for example dome-shaped or conical. Other embodiments are also conceivable for the deformation absorbers, so long as they continue to meet the requirements set for deformability in the axial and circumferential directions respectively, and in this way advantageously take the load off the tank circumferential wall. The support elements can also be in a controllable form and, for example, be in the form of a number of hydraulic piston-cylinder systems distributed around the circumference. In particular, measuring sensors can be provided here, in order to control the support elements depending on the current measured value.

The transport tanks according to the invention are intended for transporting liquids, and in particular liquids which have to be transported under ambient pressure. The transport tank is in particular designed for storage of the liquid medium therein under a maximum of substantially 1 bar excess pressure above liquid level.

The deformation absorbers can be made up of several layers, in the case of which in particular the multiple layers are not connected to each other and can therefore move relative to each other. This gives the deformation absorbers great flexibility.

In this way the invention provides a very advantageous design for a transport tank and its support in a ship's hull, which makes very great savings on material possible because of the fact that a tank circumferential wall is suspended between an upper and a lower deck, in combination with the use of deformation absorbers on the underside and upper side of the tank circumferential wall. The manufacturing and transport costs will be correspondingly low as a result, while a high level of safety and reliability of the transport is ensured, even in the event of a collision. The transport tanks can advantageously be constructed in factory conditions, and can then be connected in an insulated state or otherwise to the ship's hull. Insulation, means, if present, can be provided on the outside of the tanks. The tanks are easy to clean, and the cleaning can even be automated.

The invention claimed is:

1. A ship with one or more liquid transport tanks arranged in an upright position in a ship's hull, said transport tanks having an axial direction and a circumferential direction, and each transport tank comprising:

a tank bottom;

a tank roof; and a substantially rigid tank circumferential wall extending along said circumferential direction and having a lower end at the side of the tank bottom and an upper end at the side of the tank roof;

the tank bottom being supported on or forming part of a lower deck of the ship's hull, wherein the tank circumferential wall is suspended by its lower and upper ends by means of a lower deformable deformation absorber and an upper deformable deformation absorber between the lower deck and an upper deck of the ship's hull, which deformation absorbers are designed so as to absorb deformations between the ship's hull and the tank circumferential wall at least in the abovementioned axial direction, wherein at least the lower deformation absorber extending in the circumferential direction around the entire circumference of the tank circumferential wall, and at least the lower deformation absorber forming part of the tank wall and being accommodated at a position of a transition between the tank circumferential wall and the tank bottom so as to form a continuous sealing connection between them, wherein the axial direction is parallel to a vertical center line of the tank circumferential wall between the tank bottom and the tank roof, wherein the circumferential direction is in a tangential direction of the tank circumferential wall around the axial direction and the vertical center line, wherein the deformation absorbers are designed in such a deformable manner that deformations of the ship's hull are absorbed by deformation of the deformation absorbers with the tank circumferential wall substantially retaining its shape and not crumpling, wherein the deformation absorbers have freedom to deform at least in the axial direction both axially upward as well as axially downward, and wherein the deformation absorbers have freedom to deform in the axial direction around the entire circumference of the deformation absorbers.

2. A ship with one or more liquid transport tanks arranged in an upright position in a ship's hull, said transport tanks having an axial direction and a circumferential direction, and each transport tank comprising:

a tank bottom;

a tank roof; and a tank circumferential wall extending along said circumferential direction and having a lower end at the side of the tank bottom and an upper end at the side of the tank roof;

the tank bottom being supported on or forming part of a lower deck of the ship's hull, wherein the tank circumferential wall is suspended by its lower and upper ends by means of a lower deformable deformation absorber and an upper deformable deformation absorber between the lower deck and an upper deck of the ship's hull, which deformation absorbers are designed so as to absorb deformations between the ship's hull and the tank circumferential wall at least in the abovementioned axial direction, wherein at least the lower deformation absorber extending in the circumferential direction around substantially the entire circumference of the tank circumferential wall, and at least the lower deformation absorber forming part of the tank wall and being accommodated at a position of a transition between the tank circumferential wall and the tank bottom so as to form a continuous sealing connection between them, wherein the axial direction is parallel to a vertical center line of the tank circumferential wall between the tank bottom and the tank roof, wherein the circumferential direction is in a tangential direction of the tank circumferential wall around the axial direction and the vertical center line, and wherein, after suspension between the deformation absorbers, the tank wall sinks down in the abovementioned axial direction under the influence of gravity, at the same time deforming the deformation absorbers, and in which the deformation absorbers are of such rigidity that the following equation applies to the sinkage in the abovementioned axial direction of the tank circumferential wall, which sinkage is measured at the position of half way up the tank circumferential wall between its lower and upper ends:

$$\text{sinkage in millimeters} > Ch\sqrt{r}$$

with: $C >= 1\times10^{-7}$, h=height of the tank in millimeters and r=average radius of the tank circumferential wall in millimeters, with the tank circumferential wall being substantially cylindrical, or r=half an average cross sectional dimension of the tank circumferential wall in millimeters when the tank circumferential wall has other shapes like oval, square, multi-lobed with partitions, or polygonal.

3. The ship according to claim 2, in which $C >= 2\times10^{-7}$.

4. The ship according to claim 3, in which $C >= 10\times10^{-7}$.

5. The ship according to claim 2, in which the tank circumferential wall together with the deformation absorbers can absorb a movement of the upper deck relative to the lower deck in the axial direction of at least Y*h/1000, with Y>=1, and h=height of the tank in millimeters, without the deformation absorbers and/or the tank circumferential wall becoming plastically deformed and/or without permissible elasticity in the deformation absorbers and/or in the tank circumferential wall being exceeded.

6. The ship according to claim 5, in which Y>=2.

7. The ship according to claim 5, in which Y>=4.

8. The ship according to claim 2, in which the following applies for the ratio of the spring rigidity Cwp in the abovementioned axial direction of the tank circumferential wall together with the deformation absorbers relative to the spring rigidity Cw in the abovementioned axial direction of a reference wall which is straight all the way up, is made of the same material as the tank circumferential wall, and has the same wall thickness curve as the tank circumferential wall:

$$Cw/Cwp >= 2.$$

9. The ship according to claim 8, in which Cw/Cwp>=25.

10. The ship according to claim 9, in which Cw/Cwp>=50.

11. The ship according to claim 2, in which at least one of the deformation absorbers has a rigidity in the abovementioned circumferential direction which is greater than or equal to $1/3^{rd}$ of the rigidity in the abovementioned circumferential direction of a reference wall which is straight all the way up, is made of the same material as the tank circumferential wall, and has the same wall thickness curve as the tank circumferential wall with the deformation absorbers.

12. The ship according to claim 2, in which the deformation absorbers are arranged so as to be elastically deformable, so that at least in the abovementioned axial direction through substantially elastic deformation they absorb deformations between the ship's hull and the tank circumferential wall.

13. The ship according to claim 2, in which the upper deformation absorber extends in the circumferential direction around substantially the entire circumference of the tank circumferential wall.

14. The ship according to claim 13, in which the tank roof is supported on or forms part of an upper deck of the ship's hull, and in which the upper deformation absorber forms part of the tank wall and is accommodated at the position of a transition between the tank circumferential wall and the tank roof in order to form a continuous sealing connection between them.

15. The ship according to claim 2, in which at least one of the deformation absorbers extends partially in the axial direction and partially in the radial direction with the tank circumferential wall being substantially cylindrical.

16. The ship according to claim 2, in which a spring rigidity of at least one of the deformation absorbers in the axial direction is less than or equal to 20 Newton per millimeter of compression per millimeter of circumference.

17. The ship according to claim 16, in which the spring rigidity in the axial direction is less than or equal to 15 Newton per millimeter of compression per millimeter of circumference.

18. The ship according to claim 17, in which the abovementioned spring rigidity in the axial direction is less than or equal to 10 Newton per millimeter of compression per millimeter of circumference.

19. The ship according to claim 2, in which the following applies for the wall thickness of the tank circumferential wall:

wall thickness in millimeters <=X, and in which the following applies for X:

$$X = \text{maximum of: } \frac{K}{(\sigma_{toe})^{\frac{3}{4}}} \cdot \sqrt{h \cdot D} \text{ and } Z,$$

with: K>=0.15, Z>=10, $\sigma_{toe}$=the permissible tensile stress in the tank circumferential wall in N/mm$^2$, h=height of the tank in millimeters, and D=a diameter of the tank circumferential wall in millimeters, with the tank circumferential wall being substantially cylindrical.

20. The ship according to claim 2, in which the tank bottom is supported on the lower deck and has a maximum angle of inclination of 5° relative to the lower deck.

21. The ship according to claim 2, in which the tank roof is supported on the tank circumferential wall, and in which the upper deformation absorber extends between the upper end of the tank circumferential wall and the ship's hull.

22. The ship according to claim 2, in which at least one of the deformation absorbers is rigid in the circumferential direction of the transport tank.

23. The ship according to claim 2, in which at least one of the deformation absorbers in the axial direction of the transport tank is designed for at least partial support of the tank circumferential wall.

24. The ship according to claim 2, in which support means are provided for supporting the tank circumferential wall at least in the axial direction.

25. The ship according to claim 24, in which the support means comprise separate deformable support elements which extend between the ship's hull and the tank circumferential wall.

26. The ship according to claim 2, in which at least one of the deformation absorbers is designed as a section which is substantially quadrantal-shaped in cross section.

27. The ship according to claim 2, in which at least one of the deformation absorbers comprises stainless steel.

28. The ship according to claim 2, in which at least one of the deformation absorbers comprises fibre-reinforced plastic.

29. The ship according to claim 2, in which the inner side of the deformation absorbers is provided with a chemically resistant lining.

30. The ship according to claim 2, in which the tank bottom and/or the tank roof is (are) supported on the lower and upper deck respectively by means of an insulating layer.

31. The ship according to claim 2, in which the deformation absorber consists partially of a straight wall extending in the axial direction.

32. The ship according to claim 2, in which the transport tank is designed for storage of the liquid medium therein with an excess pressure above liquid level of less than substantially 1 bar.

33. The ship according to claim 2, in which the tank circumferential wall is substantially cylindrical.

34. The ship according to claim 2, in which the tank circumferential wall comprises one or more additional deformation absorbers between its lower and upper ends.

35. The ship according to claim 34, in which the one or more additional deformation absorbers in the tank circumferential wall are designed to be of substantially the same shape as the deformation absorbers by means of which the tank circumferential wall is suspended by its lower and/or upper end from the lower deck and the upper deck of the ship's hull.

36. The ship according to claim 2, wherein the deformation absorbers are designed in such a deformable manner that deformations of the ship's hull are absorbed by deformation of the deformation absorbers without causing deformation of or placing an undue load upon the tank circumferential wall.

37. The ship according to claim 2, wherein horizontal loads on the tank circumferential wall are transmitted to the ship's hull on the upper and lower side of the tank circumferential wall by means of shearing forces.

38. The ship according to claim 2, wherein, after suspension between the deformation absorbers, the tank circumferential wall sinks down in the axial direction under the influence of gravity, at the same time deforming the deformation absorbers.

39. The ship according to claim 2, wherein the tank circumferential wall together with the deformation absorbers can absorb a movement of the upper deck relative to the lower deck in the axial direction without the deformation absorbers and/or the tank circumferential wall becoming plastically deformed, and wherein the tank circumferential wall together with the deformation absorbers can absorb a movement of the upper deck relative to the lower deck in the axial direction without a permissible elasticity in the deformation absorbers and/or in the tank circumferential wall being exceeded.

40. A ship with one or more liquid transport tanks arranged in an upright position in a ship's hull, said transport tanks having an axial direction and a circumferential direction, and each transport tank comprising:

a tank bottom;

a tank roof; and a tank circumferential wall extending along said circumferential direction and having a lower end at the side of the tank bottom and an upper end at the side of the tank roof;

the tank bottom being supported on or forming part of a lower deck of the ship's hull, wherein the tank circumferential wall is suspended by its lower and upper ends by means of a lower deformable deformation absorber and an upper deformable deformation absorber between the lower deck and an upper deck of the ship's hull, which deformation absorbers are designed so as to absorb deformations between the ship's hull and the tank circumferential wall at least in the abovementioned axial direction, wherein at least the lower deformation absorber extending in the circumferential direction around substantially the entire circumference of the tank circumferential wall, and at least the lower deformation absorber forming part of the tank wall and being accommodated at a position of a transition between the tank circumferential wall and the tank bottom so as to form a continuous sealing connection between them, wherein the axial direction is parallel to a vertical center line of the tank circumferential wall between the tank bottom and the tank roof, wherein the circumferential direction is in a tangential direction of the tank circumferential wall around the axial direction and the vertical center line, and wherein at least one of the deformation absorbers is designed as a bellows-shaped deformation section.

41. A ship with one or more liquid transport tanks arranged in an upright position in a ship's hull, said transport tanks having an axial direction and a circumferential direction, and each transport tank comprising:

a tank bottom;

a tank roof; and a tank circumferential wall extending along said circumferential direction and having a lower end at the side of the tank bottom and an upper end at the side of the tank roof;

the tank bottom being supported on or forming part of a lower deck of the ship's hull, wherein the tank circumferential wall is suspended by its lower and upper ends by means of a lower deformable deformation absorber and an upper deformable deformation absorber between the lower deck and an upper deck of the ship's hull, which deformation absorbers are designed so as to absorb deformations between the ship's hull and the tank circumferential wall at least in the abovementioned axial direction, wherein at least the lower deformation absorber extending in the circumferential direction around substantially the entire circumference of the tank circumferential wall, and at least the lower deformation absorber forming part of the tank wall and being accommodated at a position of a transition between the tank circumferential wall and the tank bottom so as to form a continuous sealing connection between them, wherein the axial direction is parallel to a vertical center line of the tank circumferential wall between the tank bottom and the tank roof, wherein the circumferential direction is in a tangential direction of the tank circumferential wall around the axial direction and the vertical center line, and wherein the tank circumferential wall is connected to the ship by means of a skirt construction on the upper end at the side of the tank roof and/or on the lower end at the side of the tank bottom.

42. A ship with one or more liquid transport tanks arranged in an upright position in a ship's hull, said transport tanks having an axial direction and a circumferential direction, and each transport tank comprising:

a tank bottom;

a tank roof; and a tank circumferential wall extending along said circumferential direction and having a lower end at the side of the tank bottom and an upper end at the side of the tank roof;

the tank bottom being supported on or forming part of a lower deck of the ship's hull, wherein the tank circumferential wall is suspended by its lower and upper ends by means of a lower deformable deformation absorber and an upper deformable deformation absorber between the lower deck and an upper deck of the ship's hull, which deformation absorbers are designed so as to absorb deformations between the ship's hull and the tank circumferential wall at least in the abovementioned axial direction, wherein at least the lower deformation absorber extending in the circumferential direction around substantially the entire circumference of the tank circumferential wall, and at least the lower deformation absorber forming part of the tank wall and being accommodated at a position of a transition between the tank circumferential wall and the tank bottom so as to form a continuous sealing connection between them, wherein the axial direction is parallel to a vertical center line of the tank circumferential wall between the tank bottom and the tank roof, wherein the circumferential direction is in a tangential direction of the tank circumferential wall around the axial direction and the vertical center line, and wherein at least one of the deformation absorbers is designed with multiple walls.

* * * * *